US010682676B2

(12) United States Patent
Raynes, II

(10) Patent No.: US 10,682,676 B2
(45) Date of Patent: Jun. 16, 2020

(54) SELF CLEANING CONDENSATE DRAIN PRESSURE TRAP

(71) Applicant: Jack Warren Raynes, II, Mesa, AZ (US)

(72) Inventor: Jack Warren Raynes, II, Mesa, AZ (US)

(73) Assignee: Jack W. Raynes, II, Mesa, AZ (US)

( * ) Notice: Subject to any disclaimer, the term of this patent is extended or adjusted under 35 U.S.C. 154(b) by 0 days.

(21) Appl. No.: 15/894,204

(22) Filed: May 2, 2018

(65) Prior Publication Data

US 2019/0337027 A1 Nov. 7, 2019

(51) Int. Cl.
*B08B 9/032* (2006.01)
*F24F 13/22* (2006.01)

(52) U.S. Cl.
CPC ..... *B08B 9/0321* (2013.01); *F24F 13/222* (2013.01); *B08B 2203/0223* (2013.01); *F24F 2013/227* (2013.01)

(58) Field of Classification Search
CPC ..... B08B 9/0321; B08B 2203/0223; F24F 13/222; F24F 2013/227; F24F 13/22; F24F 2013/221; F25B 47/02; F25D 21/00
USPC ..... 62/150, 132
See application file for complete search history.

(56) References Cited

U.S. PATENT DOCUMENTS 5,522,229 A * 6/1996 Stuchlik, III ..... E03C 1/28 62/127
2005/0138939 A1* 6/2005 Spanger ..... F24F 13/222 62/150
2009/0188568 A1* 7/2009 Malka ..... B08B 9/0321 137/15.05
2014/0130529 A1* 5/2014 Kaiser ..... B08B 9/032 62/150

* cited by examiner

*Primary Examiner* — Justin M Jonaitis

(57) ABSTRACT

A self-cleaning condensate drain pressure trap for air conditioning is defined here comprising; a modified pressure trap and assembly; a primary condensate flow path through the pressure trap assembly; a fluid reservoir which prevents the transmission of air through the pressure trap; a fluid pumping flow path from the upper pressure trap to the lower pressure trap reservoir; a fluid pump coupled to the fluid pumping path; a control board coupled to the fluid pump, connector cable and fluid sensor; an outer protective cover for the assembly. The control boards unclogging mode is actuated by wet sensor, monitoring mode by dry sensor. Unclogging mode suspends air conditioner operation, energizes the fluid pump to pump condensate into the reservoir, whereby reservoir clogs are broken down. Where a pressure trap clog causes a high accumulation of condensate, a broken-down clog allows accumulated condensate to flow through and flush it out.

15 Claims, 22 Drawing Sheets

CONTROL BOARD
ELECTRICAL FLOW CHART
(UNCLOGGING MODE)

CONTROL BOARD
ELECTRICAL FLOW CHART
(MONITORING MODE)

SELF CLEANING CONDENSATE DRAIN PRESSURE TRAP

CROSS REFERENCE TO RELATED APPLICATIONS

Not applicable

STATEMENT REGARDING FEDERALLY SPONSORED RESEARCH OR DEVELOPMENT

Not applicable

REFERENCE TO A SEQUENCE LISTING

Not applicable

BACKGROUND OF THE INVENTION

HVAC systems, including air conditioners, experience incidents of condensate fluid flooding which creates an immense amount of damages throughout the United States every year. These damages include flooded air conditioner equipment, flooded air ducting, drywall damage, collapsed ceilings, mold, electrical shorting, mechanical damages and various other safety hazards from slip and falls to electrocution. One factor that contributes to these flooding incidents is the clogging of condensate drain fluid pressure traps. Pressure traps are an integral part of HVAC equipment condensate fluid drainage systems.

A condensate fluid pressure trap is a U-shaped section of drainpipe that is installed onto air conditioner condensate drainpipes which allows for condensate fluid to completely fill a portion of the drainpipe. Pressure traps prevent the transmission of air through the condensate drainpipe which allows for proper drainage.

Condensate pressure traps become clogged with dust, debris and slime that drain into the pressure trap from the air conditioner drain pan. The bacterial slime, called zooglea, can also grow inside the pressure trap. These materials will collect in the bottom/reservoir of the U-shaped trap until a clog forms. When the clogs occur condensate fluid cannot drain through the pressure trap and the fluid backs up into the air conditioner condensate pan filling it up until it flows over the top and causing flooding.

The invention Self-cleaning condensate drain pressure trap for air conditioning improves on the design of the traditional type HVAC condensate pressure trap. The design retains the fluid trapping ability while enabling the invention to unclog itself if the need arises. The device mimics a simple procedure I've performed during my 15 years of professional HVAC services which effectively unclogs pressure traps. The process uses the condensate fluid created by the clog as an unclogging medium. With the aid of a fluid pump to stir up the pressure trap debris clog, gravity becomes the means by which the clog is flushed out of the condensate pressure trap. This process allows for a safe and undamaging means of p-trap unclogging. The invention also incorporates an overflow safety shutdown function for the air conditioning system which halts further production of condensate fluid until the drainage issue is resolved.

The Self-cleaning condensate pressure trap for air conditioning is a low pressure, minimally invasive device. The invention does not pressurize condensate drainpipes nor was it designed to clear obstructions along the entire condensate drain system flow path. This device only treats one type of condensate drainpipe clogging while providing a safety against the other types.

The majority of the invention's mechanisms are encased within a protective outer cover. The cover is constructed of a plastic material which is resistant to sunlight, high ambient heat, rain and moisture. The outer covers protect the vulnerable mechanisms of the device from weathering, which allows the device to be applied in outdoor as well as indoor HVAC applications.

A more detailed description of the invention, its components and operations will become apparent by examination of the summary, drawings and detailed description.

BRIEF SUMMARY OF THE INVENTION

The Self-cleaning condensate drain pressure trap for air conditioning invention is a fluid pressure trap device designed to be installed on the condensate drainpipes of air conditioners. The invention is a modification of the standard type HVAC industry condensate pressure trap and it conforms to international mechanical codes as such. Its primary function is a condensate drain fluid pressure trap that provides for proper condensate fluid drainage in HVAC condensate drainage systems. The inventions secondary function is to unclog the devices pressure trap if the p-traps primary condensate fluid flow path becomes restricted by a debris clog. Thirdly, the invention functions as a condensate fluid overflow safety shutoff device, capable of halting the cooling operations and condensate fluid production of the air conditioner the device is installed onto.

In one embodiment the invention comprises the U-shaped fluid pressure trap assembly where; the access coupling T mounts onto the fluid pressure trap to complete the primary condensate fluid flow path of the device; the primary fluid flow path beginning at the high side fluid port and ending at the low side fluid port; a set of fluid sensor wires that are encased within a splash guard are mounted into the top of the access coupling T.

Molded onto the pressure trap are the high side and low side pump access ports. These ports allow for condensate fluid to be extracted from the upper portion of the pressure trap pipe and then pumped into the bottom/reservoir portion of the pressure trap pipe. The fluid pumping flow path through the pump access ports is perpendicular to the primary condensate fluid flow path through the pressure trap assembly.

A fluid pump having an inlet and outlet where; the fluid pump is coupled to the fluid pumping flow path; the pumps fluid inlet connects to the high side pump access port via plastic tubing; the pumps fluid outlet connects to the low side pump access port via plastic tubing. The fluid pump pumps condensate fluid from the high side pump access port through the low side pump access port during the inventions unclogging function.

Most or all the invention's functions are actuated through the devices control board. The control board is electrically powered through the connector cable which conducts electric current from an air conditioner that the device is installed onto. The control board interfaces with the air conditioner via the connector cable in a configuration where the control board can suspend air conditioning operations in order to halt condensate fluid production. The control board is also connected to the device's fluid sensor wires where the sensor wires report to the control board a state of being either wet or dry. Lastly, the control board is connected to the fluid pump; where the pump is actuated to a pump on or a pump off state depending on the wet or dry state of the sensor wires.

The control boards normally static state is in monitoring mode. When the sensor wires become wet the control board switches from monitoring mode to the unclogging mode where; A/C operations are suspended to halt further condensate fluid production; the fluid pump is energized to pump condensate fluid along the fluid pumping flow path and into the pressure trap reservoir. It is a well-known fact that pressure trap clogs most always occur in the reservoir.

A clog in the pressure trap reservoir is basically a dam which is restricting condensate fluid drainage. This causes the condensate fluid to rise in the pressure trap assembly and correspondingly in the air conditioners condensate drain pan. The devices sensor wires are preset to the highest permittable fluid level within the pressure trap assembly. This permittable fluid level corresponds to a level in the air conditioner drain pan where the pan will be full condensate fluid, but not overflowing. When a high fluid level triggers a wet state of the sensor wires the control boards unclogging mode initiates. As the fluid pump pumps condensate fluid into the pressure trap reservoir any clog there is broken down by the swirling fluid motion created. By this action the watertight integrity of the clog is diminished, and the loose clog allows the condensate fluid to flow past. As the condensate begins draining out of the drain pan and flowing through the clog the clog particles are carried away along with the fluid flow. Suddenly, the clog will break free from the reservoir as condensate fluid gushes out of the air conditioner washing it all away. The condensate fluids velocity is aided by the downhill slope of the primary condensate flow path through the pressure trap. I have witnessed this unclogging effect countless times in the field and in my laboratory as well.

After a successful unclogging mode operation and the condensate fluid level recedes the fluid sensor wires report a dry state to the control board and a 15 second delay begins. After the delay proves the dry state the control board actuates the fluid pump to a pump off state and resumes the air conditioning equipment operations. If the sensor wires continue to report a wet state to the control board this may indicate that a condensate drainpipe restriction exists elsewhere along the drainpipe. In this instance the control board will continue to operate in the unclogging mode.

Most of the invention's mechanisms are encased within an outer protective cover. There are openings in the cover where the condensate fluid entrance and exit points extend out so that the drainpipe connection to an air conditioner can be made. The connector cable also protrudes from the protective cover so that the electrical connections to an air conditioner can be made. The cover is constructed from a plastic material which is resistant to sunlight, high ambient heat, rain and moisture. The outer covers protect the vulnerable mechanisms of the device from weathering, which allows the device to be applied in outdoor as well as indoor applications.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for describing particular embodiments only and is not intended to be limiting of the invention.

Unless otherwise defined, all the terms used herein have the same common meaning as understood by one having ordinary skill in the art to which this invention belongs. It is to be understood that the terms used herein will have the same common meaning as they are to be described in a common English dictionary, the terms should also be interpreted by any relative meaning that they would have in the context of relative art.

In describing the invention several techniques will be disclosed. Each technique described will be of benefit to itself and possibly of others in the description, or to all. This description will refrain from repeating various steps in unnecessary fashion for the purpose of clarity. The specification and claims should be read as so these descriptions are within the scope of the invention and claims.

A new Self-cleaning condensate drain pressure trap for air conditioning systems will be disclosed herein. The following descriptions will explain the specific details in the operations of the device. This disclosure is an example of the invention, and it is not intended to limit the invention to the specific uses that are illustrated by the figures and descriptions below.

This invention is a condensate drain fluid pressure trap with unclogging ability and overflow safety for HVAC equipment including air conditioners. Several different examples of air conditioning and other HVAC equipment may be depicted in the annotated figures and included in the wording of the detailed description of the invention, as such. However, air conditioners and other HVAC equipment are not an integral part of the invention and their mention or description only serves to description only serves to facilitate the explanation of their properties as they relate to the invention Self-cleaning condensate drain pressure trap for air conditioning.

The present invention will now be described referencing the appended figures representing preferred embodiments. After each figure has been briefly described there will be a description of the invention's usage and sequence of operations.

Description of the Figures

Figure 1:
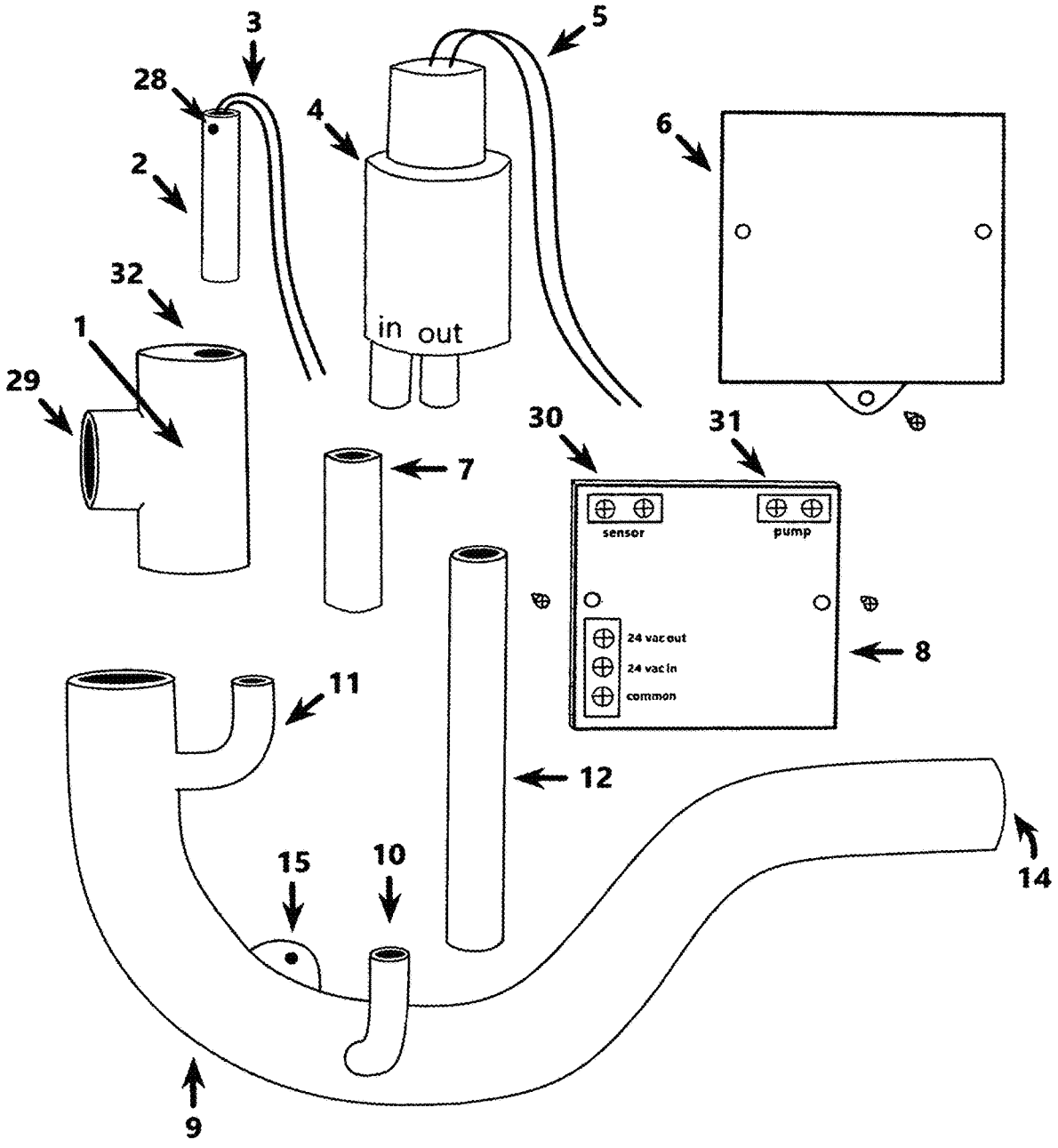
FIG. 1—FIG. 1 depicts an exploded perspective view of a self-cleaning air conditioning condensate drain pressure trap, according to various embodiments of the present invention.

FIG. 1. Depicts an exploded front side perspective view of the elements that may comprise a Self-cleaning condensate drain pressure trap for air conditioning according to various embodiments of the present invention.

In FIG. 1, the inventions pressure trap 9 is depicted as a U-shaped plastic tube onto which there are several molded plastic appendages 10,11 and 15. The pressure trap 9 is molded from a plastic known as ASA. This material was chosen to mold the pressure trap because it has a deflection temperature from 190 to 220 degrees Fahrenheit. ASA is generally used to mold items such as outdoor furniture and automotive parts due to its resistance to weathering, higher temperatures and UV rays.

In FIG. 1, the inventions access coupling T 1 is depicted as a plastic tubing T-coupling. The T-shaped coupling 1 connects the pressure trap 9 to an air conditioners condensate drain line at the high side fluid port 29. Condensate fluid enters the device at the high side fluid port 29. The access coupling T 1 is molded from the plastic material known as ASA.

In FIG. 1, The inventions sensor wires 3 and splash guard 2 are depicted. The sensor wires 3 are inserted into the splash guard 2 and sealed at the top of the splash guard 2 with glue. Together, items 2 and 3 form the inventions fluid sensor assembly. The fluid sensor assembly is mounted into the top of the access coupling T 1 at the sensor hole 32.

In FIG. 1, The inventions fluid pump 4 is depicted. The fluid pumps 4 power wires 5 extend from the top of the fluid pump. The fluid pump 4 has a fluid inlet and fluid outlet. When energized the fluid pump 4 pumps condensate fluid from the high side pump access port 11 into the low side pump access port 10 along the fluid pumping flow path.

In FIG. 1, the inventions plastic tubing upper 7 and plastic tubing lower 12 are depicted. The Plastic tubing upper 7 connects the fluid inlet of fluid pump 4 to the high side pump access port 11. The Plastic tubing lower 12 connects the fluid outlet of fluid pump 4 to the low side pump access port 10.

In FIG. 1, the inventions control board 8 is depicted. The control board 8 is a printed circuit board which is the inventions main control mechanism. The control board 8 is mounted onto the PCB mounting bracket 6.

In FIG. 1, the low side access port 14 is depicted. The low side access port 14 is the lower pipe end of the pressure trap 9 where condensate fluid from an air conditioner exits or drains out from the invention.

Figure 2:
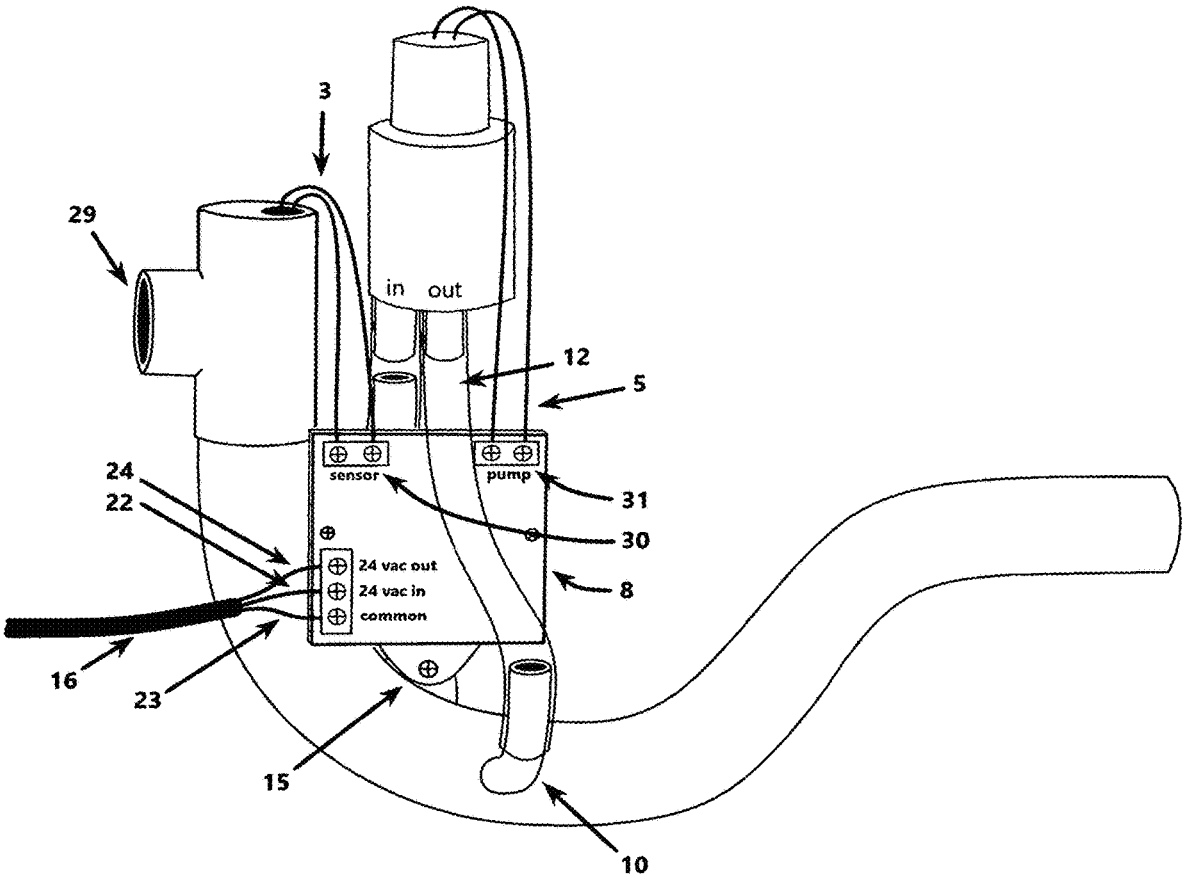
FIG. 2—FIG. 2 Illustrates an exposed and partially exploded mechanical front side profile view of one example of a self-cleaning air conditioning condensate pressure trap according to various embodiments described herein.

In FIG. 2, the partially exploded front side profile view of the pressure trap assembly is illustrated.

In FIG. 2, the control board 8 is depicted mounted onto the PCB mounting bracket 6 where; the PCB mounting bracket 6 is screwed onto the control mounting tab 15.

FIG. 2 illustrates the connector cable 16 containing connector cable wire A 22, connector cable wire C 23 and connector cable wire B 24 connected to the inventions control board 8. These wiring connections serve as the inventions main electrical power input/output elements which convey electric current to and from an air conditioner for which the invention may be serving.

In FIG. 2, connector cable wire A 22 is depicted connecting to the control board 8 terminal labeled "24 vac in".

In FIG. 2, connector cable wire C 23 is depicted connecting to the control board 8 terminal labeled "common".

In FIG. 2, connector cable wire B 24 is depicted connecting to the control board 8 terminal labeled "24 vac out".

In FIG. 2, the sensor wires 3 are depicted connected to the control board 8 terminal labeled "sensor" 30. The sensor wires 3 report whether they are either wet or dry to the control board 8 sensor terminal 30.

In FIG. 2, the pump wires 5 are depicted connected to the control board 8 terminal labeled "pump" 31. The pump terminal 31 on the control board 8 supplies 24 volt-dc electrical power to the fluid pump 4 via the pump wires 5, when required.

In FIG. 2, the fluid pump's 4 outlet is depicted connected to the low side pump access port 10 via the plastic tubing lower 12.

Figure 3:
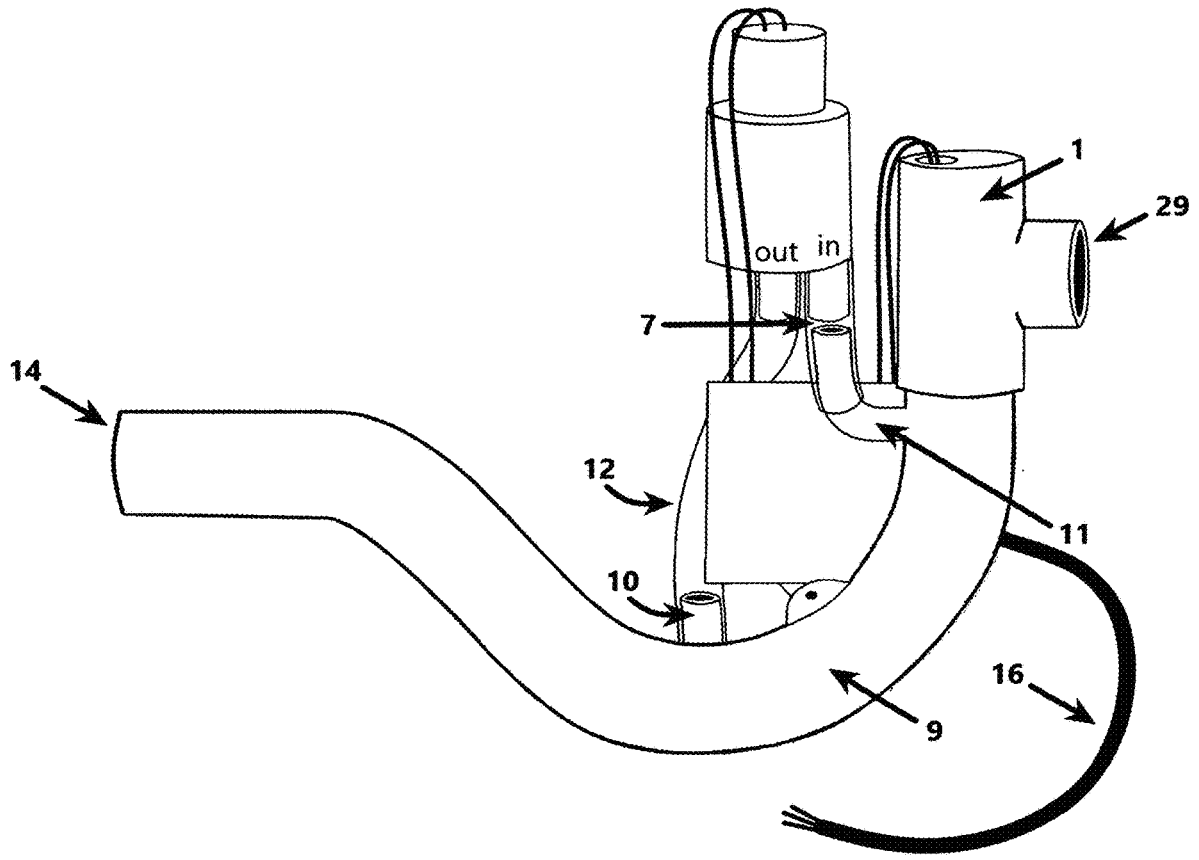
FIG. 3—FIG. 3 shows an exposed and partially exploded mechanical back side profile view (reverse of FIG. 2) of one example of a self-cleaning air conditioning condensate pressure trap according to various embodiments described herein.

In FIG. 3, the partially exploded rear side profile view of the pressure trap assembly is depicted. Here the fluid pump 4 inlet is depicted connected to the high side pump access port 11 via the plastic tubing upper 7.

Figure 4:
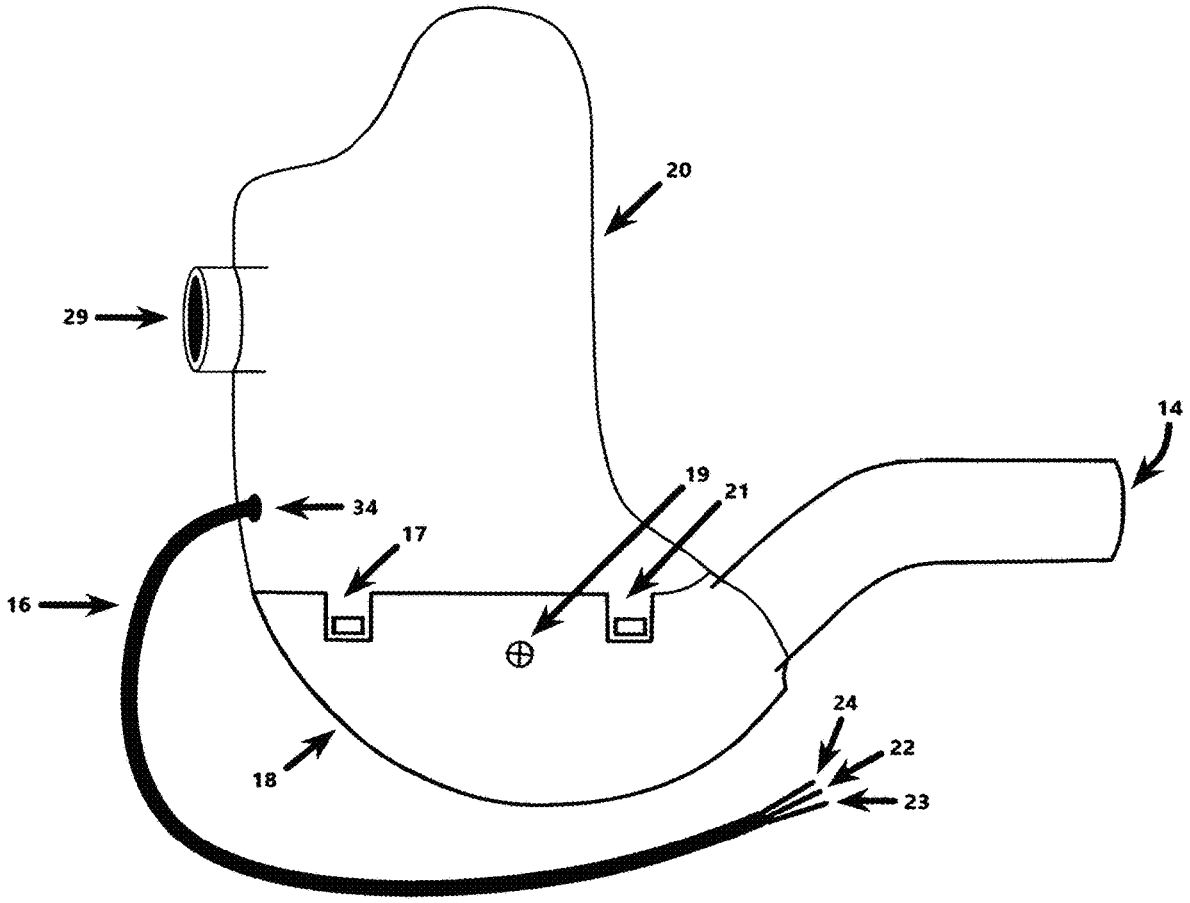
FIG. 4—FIG. 4 depicts an example of an encapsulated front side profile view of a self-cleaning air conditioning condensate pressure trap according to various embodiments described herein.

In FIG. 4, the encapsulated front side profile view of the outer covers 18, 20 are depicted. Here the invention is depicted with the majority its mechanisms encased within the outer protective covers 18, 20. The outer protective covers protect the invention from certain elements that would damage parts of the device. These damaging elements include rain, moisture, dirt, dust, sunlight, high ambient heat and general weathering. The outer protective covers 18, 20 protect the device from these elements to the degree that these elements occur in nature and to the degree that the construction materials were designed to withstand these elements.

The outer protective covers consist of a top cover 20 and a bottom cover 18. In FIG. 4, the top and bottom covers 18, 20 are mated and snap together via the mating clip tabs 17 and 21. The two covers are further secured together by a screw 19.

In FIG. 4, the connector cable 16 is depicted routed through the cable hole 34 which is situated on the front of the top cover 20.

In preferred embodiments the plastic material Zytel is used to mold the devices outer protective covers 18, 20. Zytel has a deflection point of approximately 284 degrees Fahrenheit, meaning the plastic must reach that temperature before it will begin deforming. This material was chosen since the covers 18, 20 will bear the brunt of the weathering that the invention will incur outdoors. The plastic material was also chosen because it is incredibly resistant to the suns UV rays.

Figure 5:
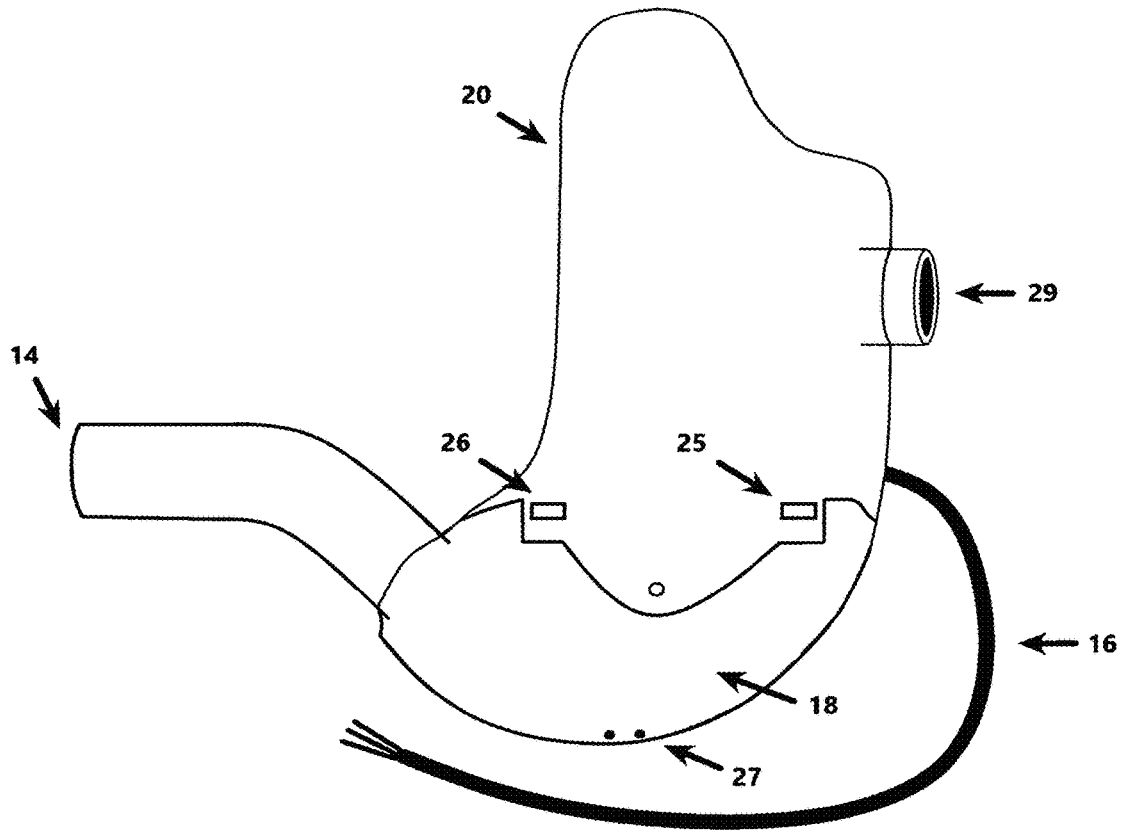
FIG. 5—FIG. 5 shows an example of an encapsulated rear side profile view (reverse of FIG. 4) of a self-cleaning air conditioning condensate pressure trap according to various embodiments described herein.

In FIG. 5, the encapsulated rear side profile view of the outer protective covers 18, 20 are depicted. Here the mating clips 25, 26 are depicted. These clips snap together securing the top and bottom outer protective covers when they are mated.

In FIG. 5, near the lower end of the bottom cover 18 there is a small weep hole 27 depicted. The weep hole 27 functions as a drainage port of the invention. If any moisture accumulates on the inner walls of the outer protective covers 18, 20 the moisture can drain from the device through this orifice.

Figure 6:
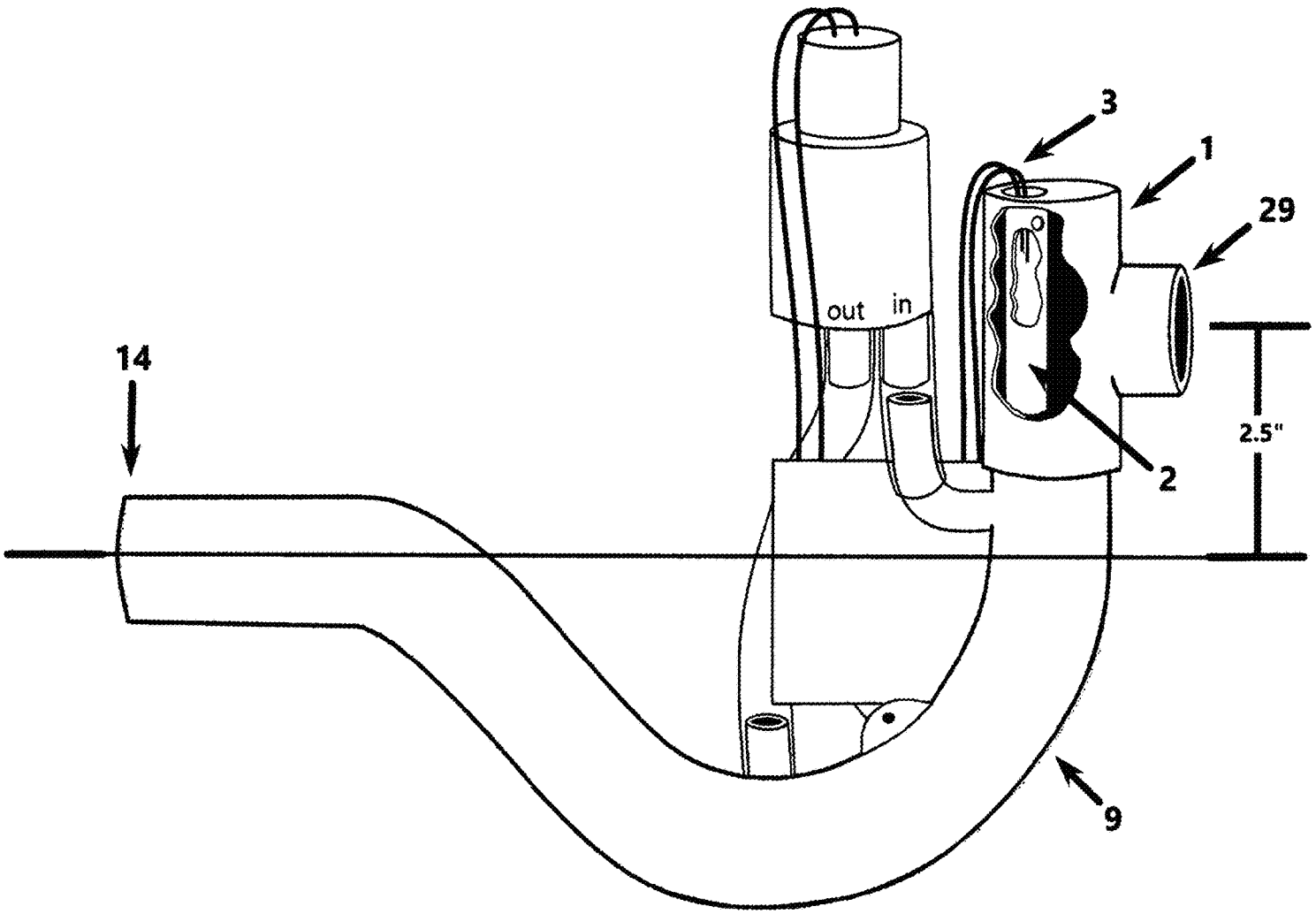
FIG. 6—FIG. 6 shows an exposed and partially exploded mechanical back side profile view (reverse of FIG. 2) of one example of a self-cleaning air conditioning condensate pressure trap according to various embodiments described herein. A cut-away view into the access coupling T 1 and splash guard 2 are also depicted.

In FIG. 6, the partially exploded rear side profile view of the inventions pressure trap assembly is depicted. Cut away views of the assemblies access coupling T 1 and splash guard 2 are illustrated in order to better visually define the fluid sensor assembly 2, 3. In this depiction the sensor wires 3 are depicted as they are orientated within the splash guard 2. Note the vertical spacing between the tips of the wires 3 and the vertical height that the wires are set to within the splash guard 2.

In FIG. 6, horizontal and vertical measurement lines are depicted across the pressure trap assembly. These measurements illustrate the grade or slope between the high side fluid port 29 and low side fluid port 14 of the pressure trap assembly 9, 1. The slope adds a gravitational element to the flow of condensate fluid through the device's primary condensate fluid flow path.

Figure 7:
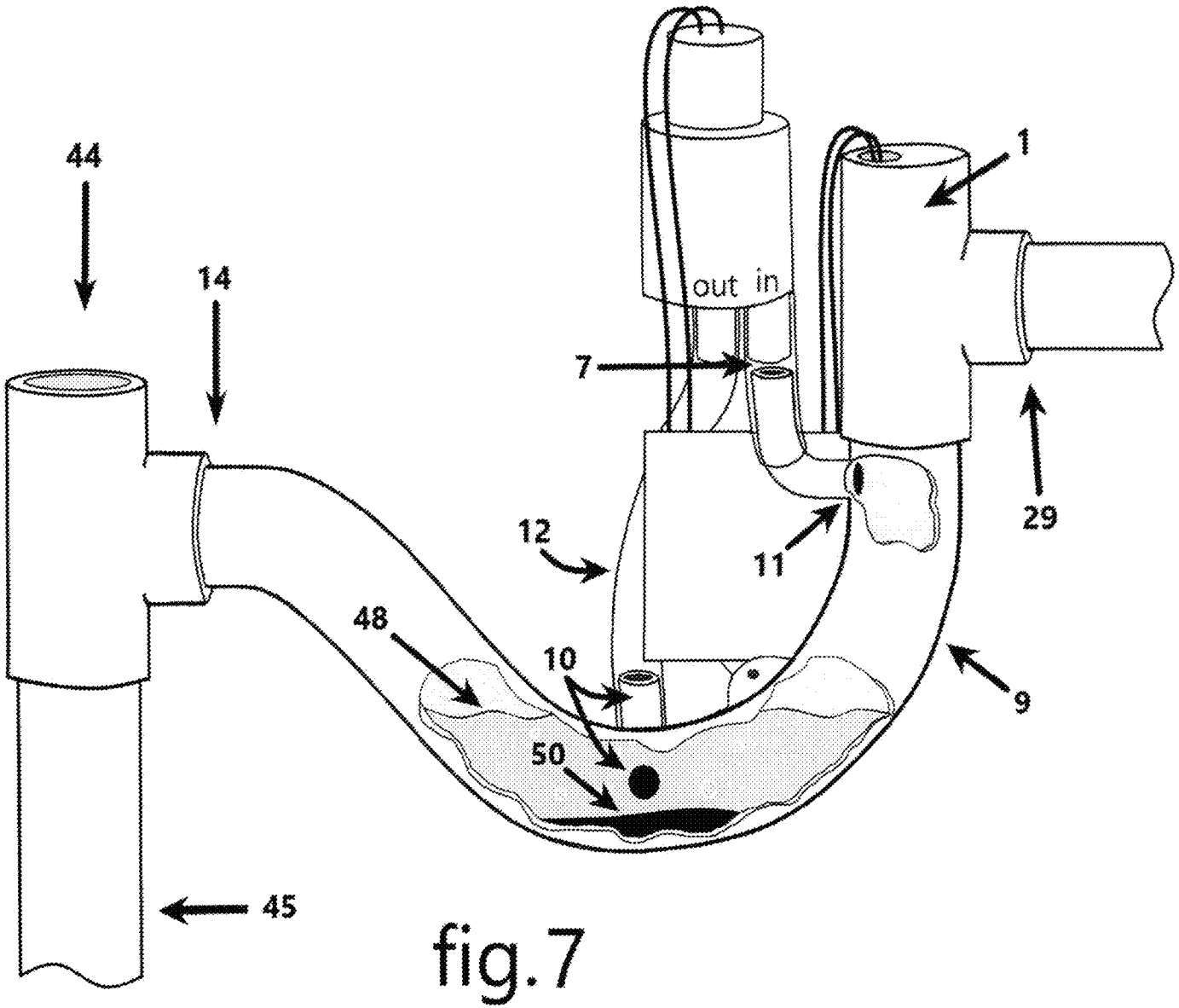
FIG. 7—FIG. 7 shows an exposed and partially exploded mechanical back side profile view of one example of a self-cleaning air conditioning condensate pressure trap according to various embodiments described herein. A cut-away view into the pressure trap 9 of the invention is depicted.
Figure 8:
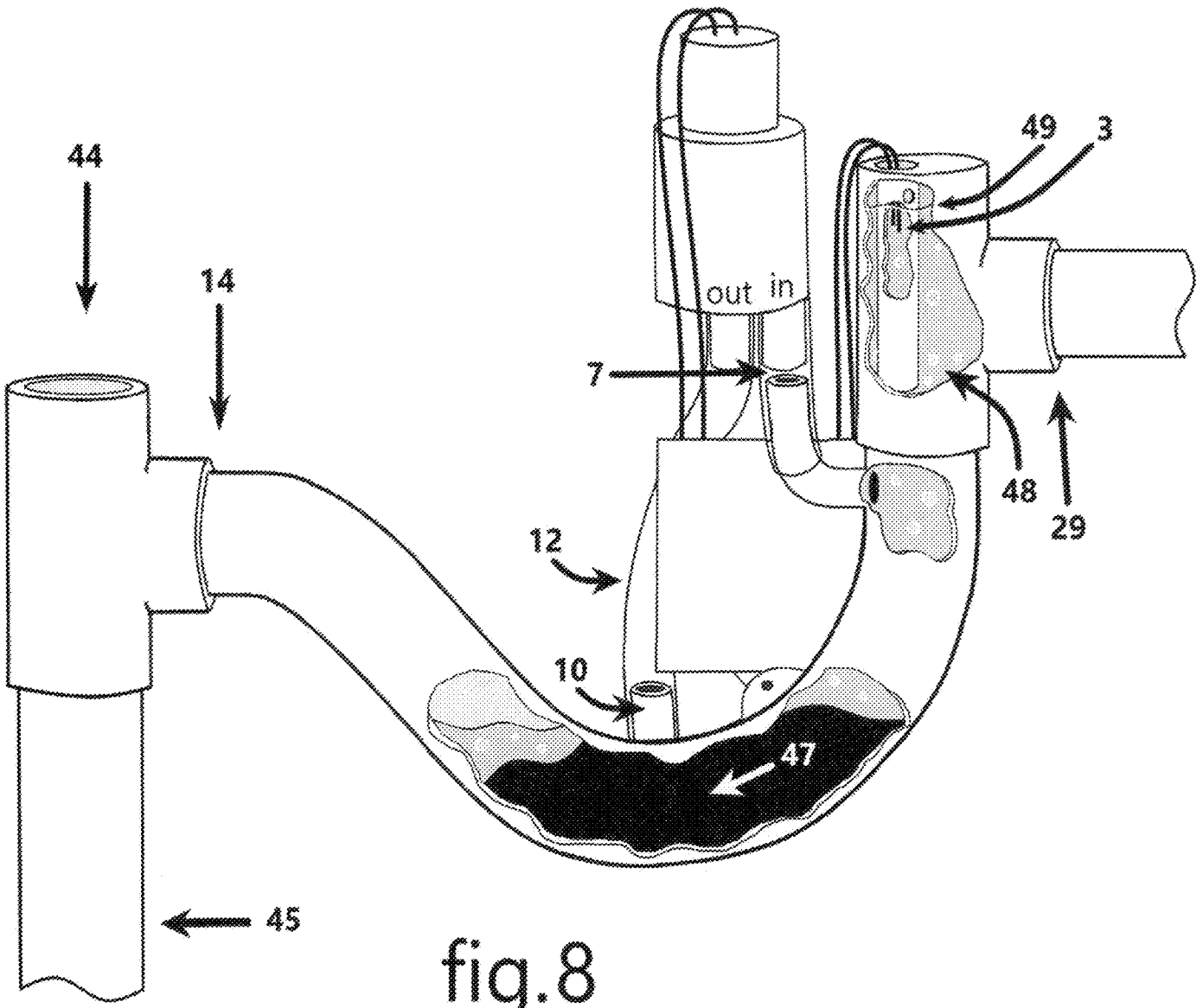
FIG. 8—FIG. 8 shows an exposed and partially exploded mechanical back side profile view of one example of a self-cleaning air conditioning condensate pressure trap according to various embodiments described herein. This figure illustrates a cut-away view of the pressure trap 9 and a cut-away view of the access coupling T 1 of the invention.
Figure 9:
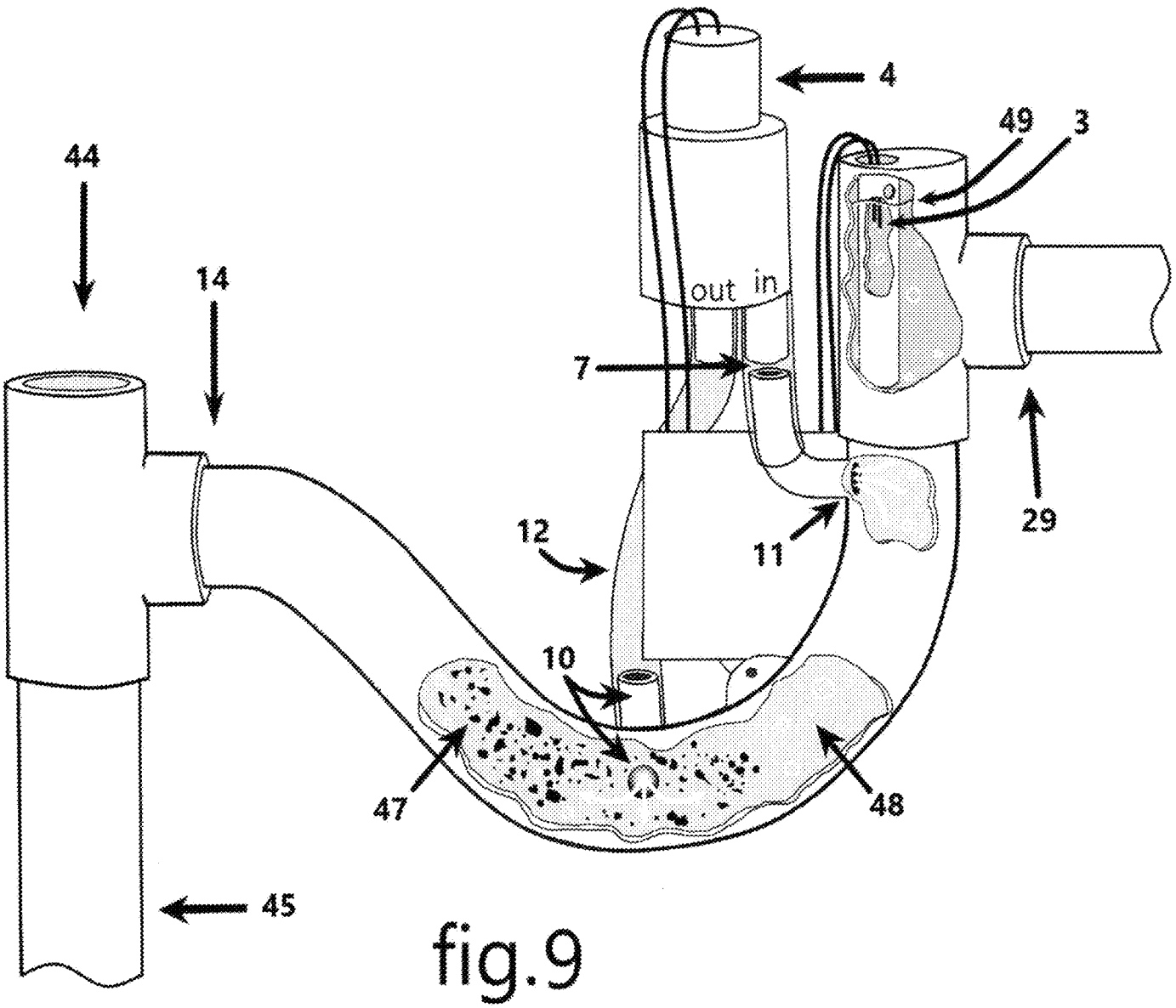
FIG. 9—FIG. 9 shows an exposed and partially exploded mechanical back side profile view of one example of a self-cleaning air conditioning condensate pressure trap according to various embodiments described herein. This figure illustrates a cut-away view of the pressure trap 9 and a cut-away view of the access coupling T 1 of the invention.

In FIGS. 7 through 9 partially exploded rear side profile views of the invention are depicted. It is to be assumed that the views of the invention illustrated in FIGS. 7-9 depict the device in an operational state as it might be connected to operating air conditioner. Air conditioning equipment is not depicted in FIGS. 7-9 due to the images enlarged nature.

In FIG. 7, the partially exploded rear side profile view of the invention depicts the pressure trap assembly 9, 1 with cutaway views to the inside the of the pressure trap 9. This view illustrates an example of how condensate fluid 48 drainage from an HVAC system may pool in the bottom of the pressure trap 9 during normal air conditioning cooling operations. Note that an amount of evaporator coil debris 50 has settled in the bottom of the pressure trap 9.

In FIG. 8, the partially exploded rear side view of the invention depicts the pressure trap assembly 9, 1 with cutaway views to the inside of the pressure trap 9 and the access coupling T 1. This view illustrates how a buildup of evaporator coil debris 50 inside the pressure trap 9 can form into a pressure trap debris clog 47 and restrict condensate fluid drainage. The condensate fluid 48 cannot drain out due to the clog 47. The condensate fluid 48 has risen into the access coupling T 1 and the splash guard 2, submerging the sensor wires 3 in condensate fluid 48.

In FIG. 9, the partially exploded rear side view of the invention depicts the pressure trap assembly with cutaway views to the inside of the pressure trap 9 and the access coupling T 1. Here the pressure trap debris clog 47, seen in FIG. 8, is being broken down into smaller particles as fluid is pumped through the low side pump access port 10 by the fluid pump 4.

Figure 10:
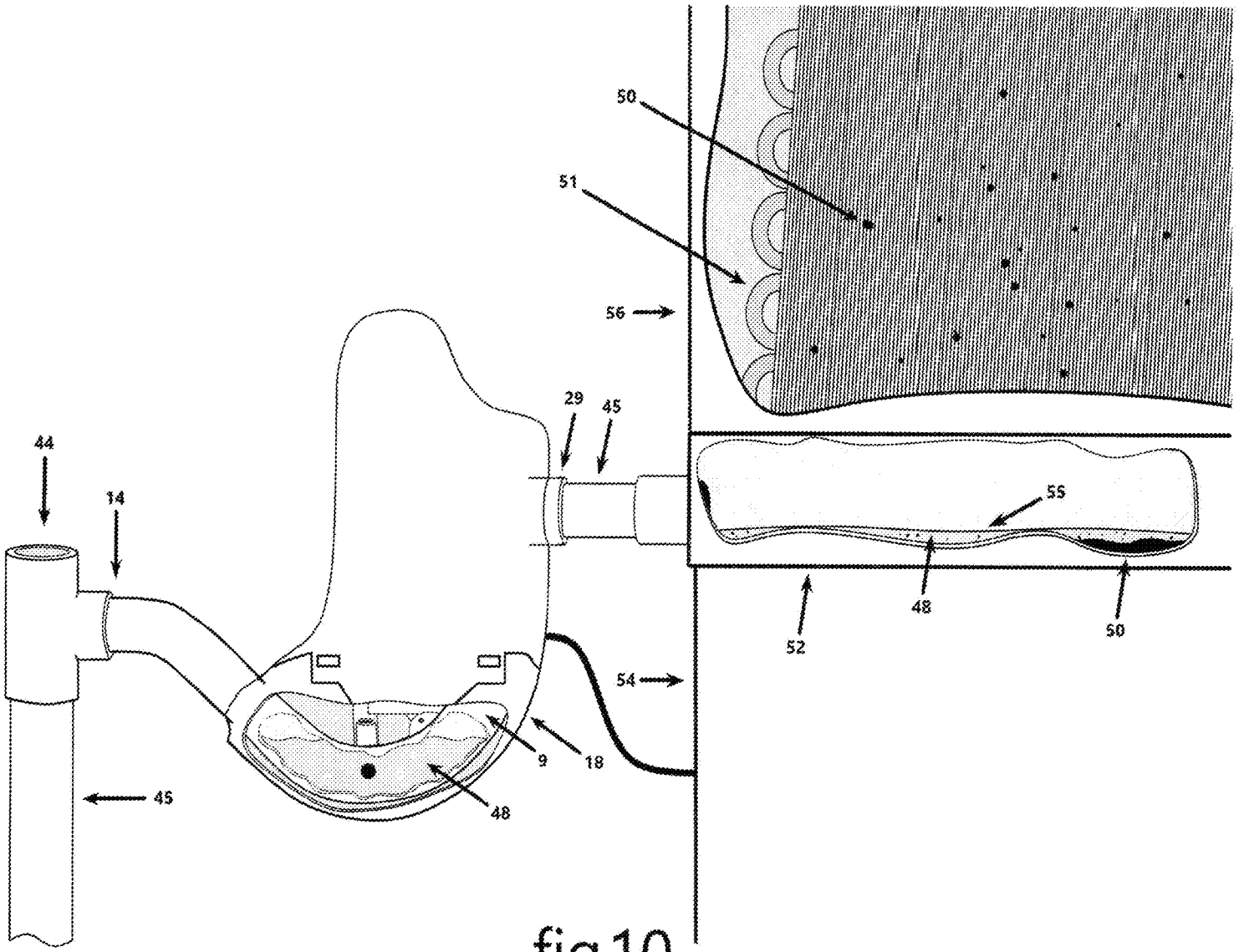
FIG. 10—FIG. 10 depicts an encapsulated rear side profile view of the invention connected to a condensate drainpipe 45 of one example of a split system air handler 54. Several cut-away views of various elements are depicted.

In FIG. 10, The invention is depicted in an encapsulated rear side profile view connected to an example of a split system air handler 54. Depicted in the figure are cutaway views of a condensate drain pan 52 and an evaporator coil cabinet 56 as well as the inventions bottom cover 18 and pressure trap 9. These views illustrate an example of how condensate fluid 48 may appear at normal operating levels in these systems during normal air conditioning operations. The cut away view of the evaporator coil cabinet 56 depicts how evaporator coil debris 50 can accumulate on an evaporator coil 51.

Figure 11:
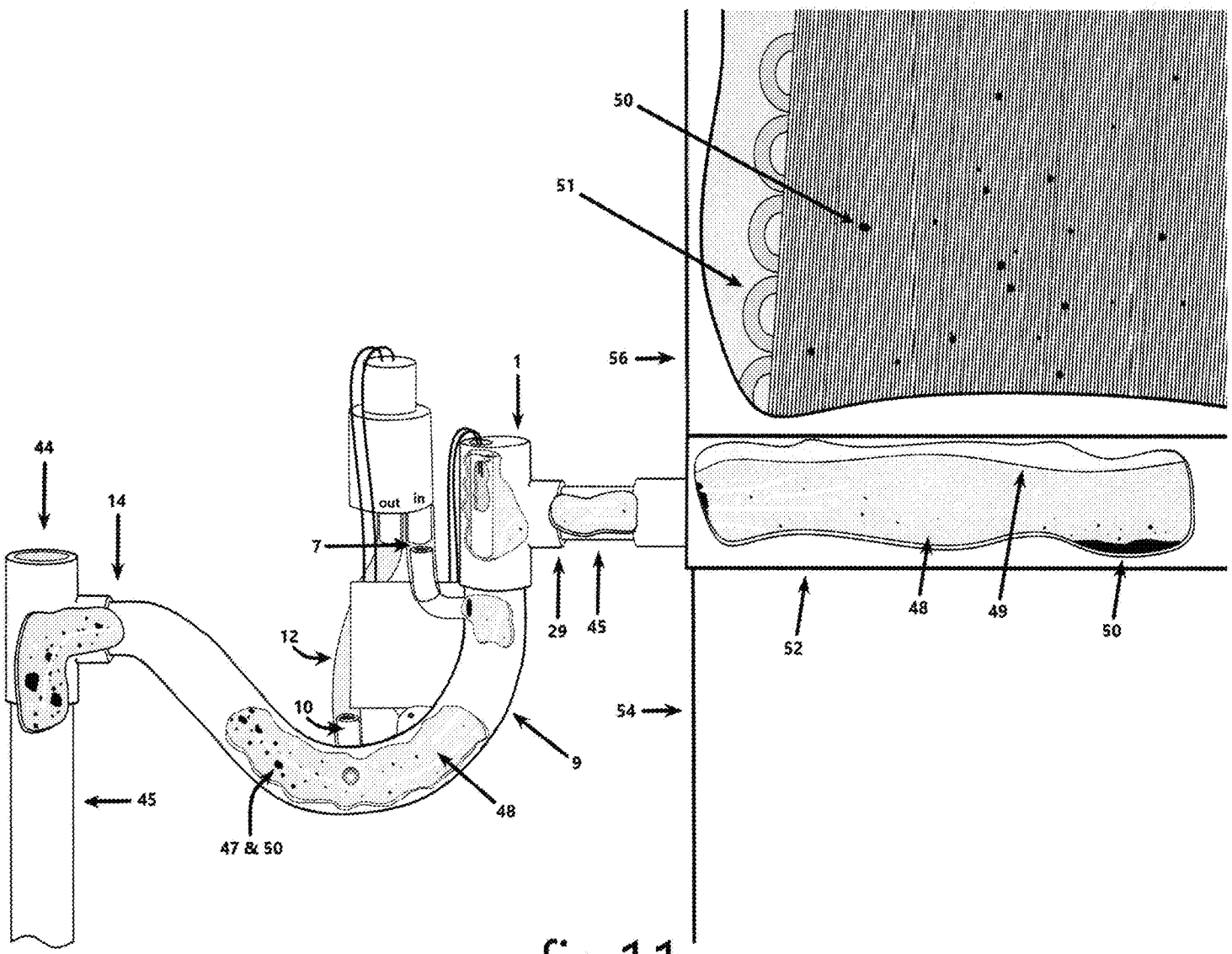
FIG. 11—FIG. 11 depicts an exposed and partially exploded mechanical back side profile view of the invention connected to a condensate drainpipe 45 of one example of a split system air handler 54. Several cut-away views of various elements are depicted.

In FIG. 11, The invention is depicted in a partially exploded rear side profile view connected to one example of a split system air handler 54. Here cutaway views of an air conditioner condensate drain pan 52, evaporator coil cabinet 56, condensate line coupling 44 and condensate drainpipe 45, as well as the inventions access coupling T 1, pressure trap 9 and splash guard 2 are depicted. These cut away views illustrate how condensate fluid 48 which has risen to a high fluid level 49 can flush out the remnants of a broken-down pressure trap clog 47 from the pressure trap 9 via the gravitational force of the draining fluid.

Figure 12:
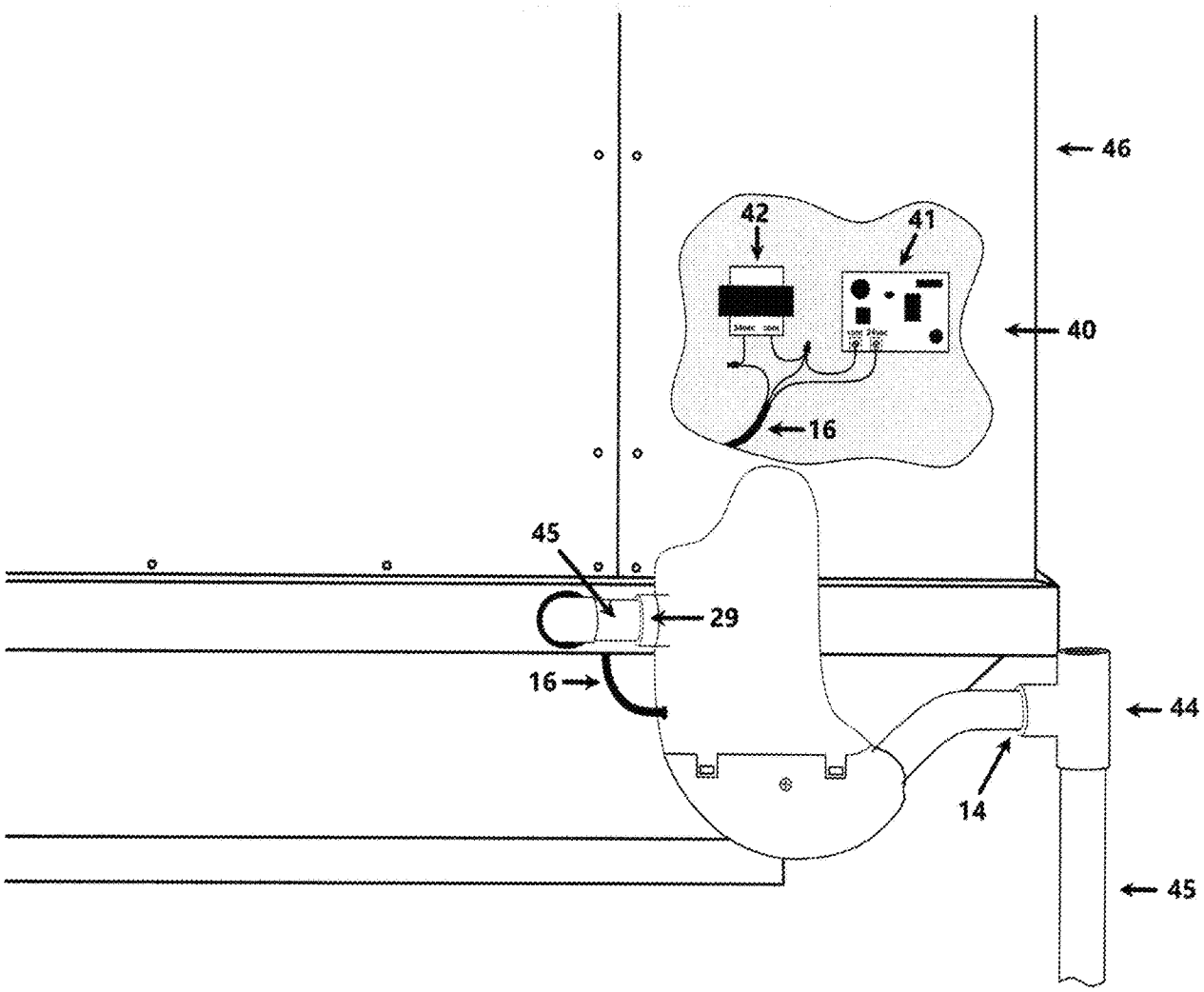
FIG. 12—FIG. 12 depicts an encapsulated front side profile view of a self-cleaning air conditioning condensate pressure trap according to various embodiments described herein. The invention is depicted here as it could be connected to one example of a package air conditioner 46. Also depicted is a cut-away view of one example of an electric control panel 40.

In FIG. 12, the invention is depicted in an encapsulated front side profile view as it may be installed onto a package air conditioner 46. Also depicted is a cutaway view of an example of the air conditioners electric service panel 40. The invention is here wired to components within the service panel 40.

Figure 13:
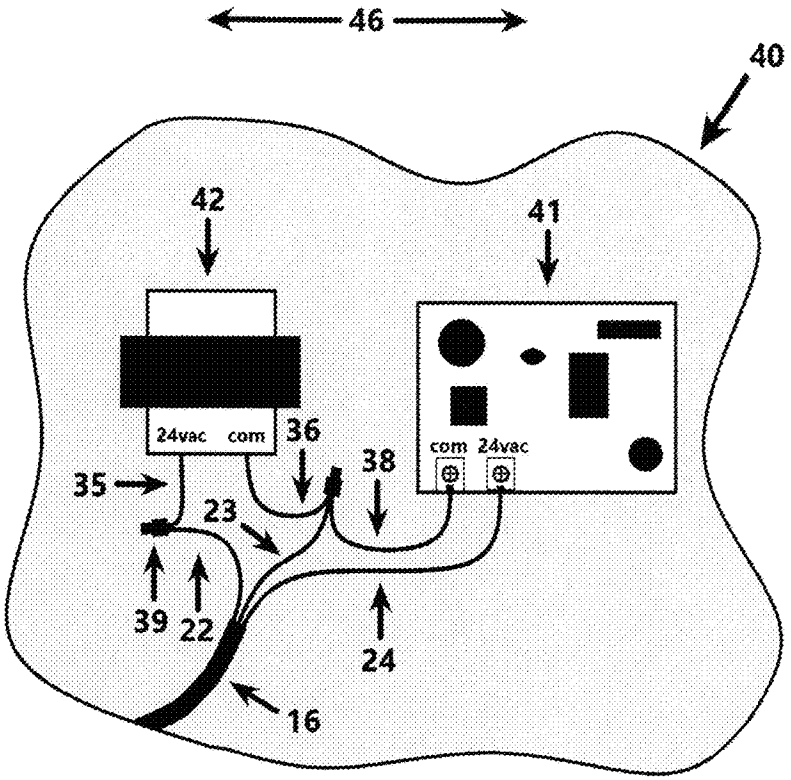
FIG. 13—FIG. 13 depicts a cut away view of one example of one an electric control panel 40 of an air conditioner.

In FIG. 13, a cutaway view of an example of an air conditioners electric service panel 40 is depicted. This view illustrates the wiring connections of the invention's connector cable 16 to examples of an air conditioner 24-volt ac transformer 42 and air conditioner control board 41. These wiring connections convey electrical power to and from the invention in order to facilitate the inventions functions.

Figure 14:
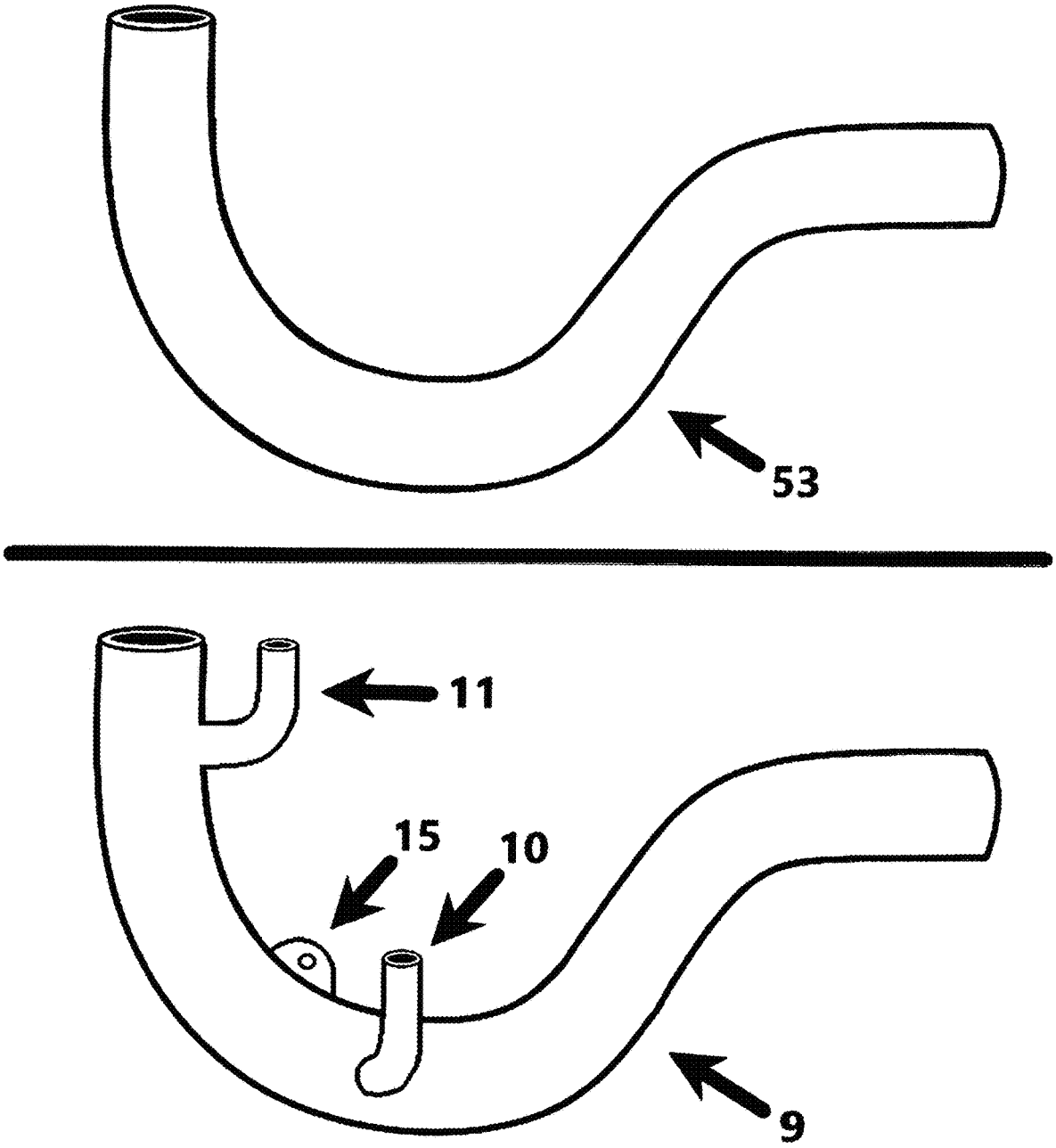
FIG. 14—FIG. 14 depicts one example of a front side profile view of the inventions pressure trap 9, according to various embodiments. Also depicted is one example of a standard HVAC condensate pressure trap 53.

FIG. 14 depicts a side by side comparison of the inventions pressure trap 9 and one example of an HVAC industry standard pressure trap 53. The HVAC industry standard pressure trap 53 is not a part of the invention and is depicted here only for comparison purposes.

Figure 15:
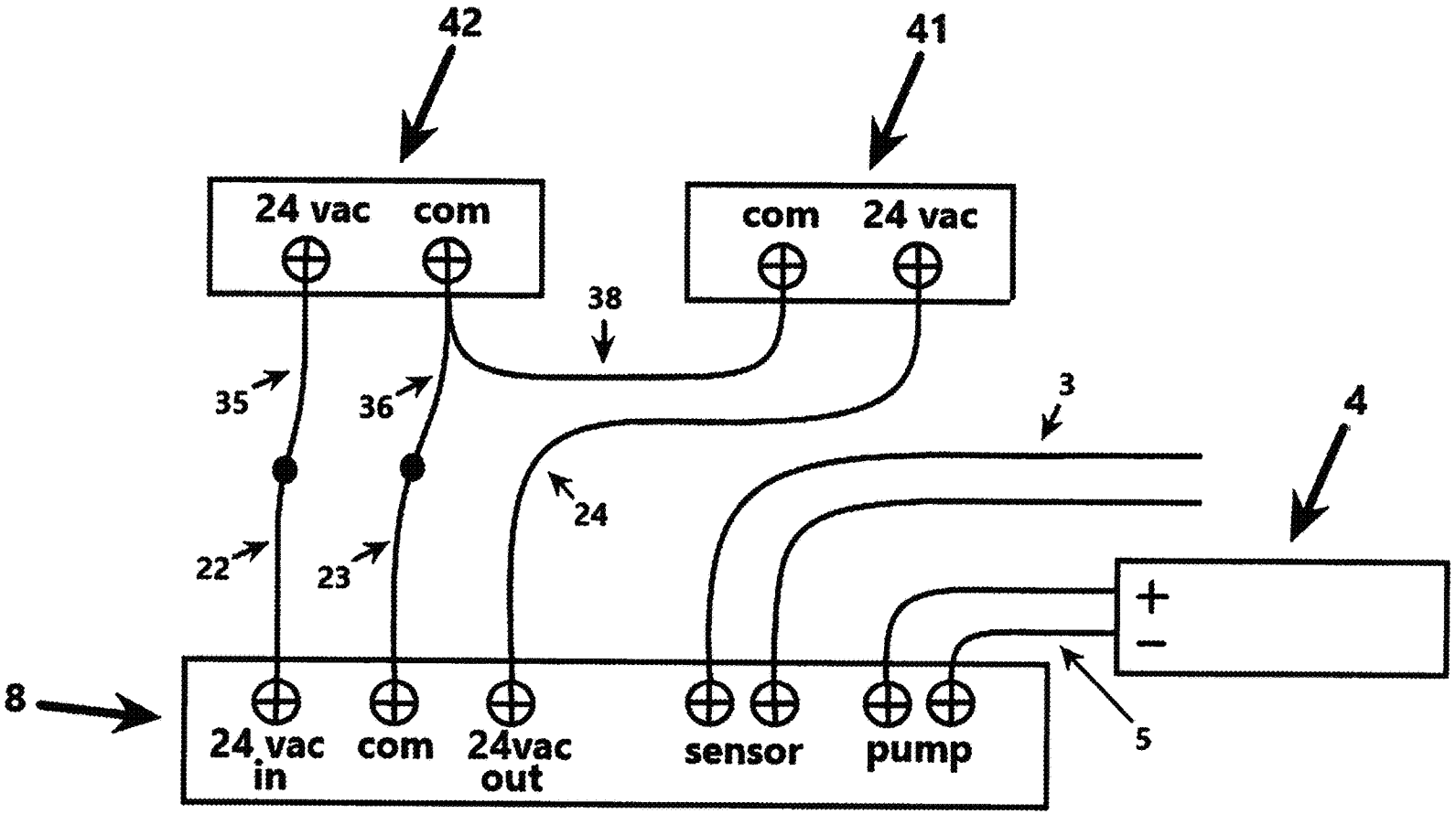
FIG. 15—FIG. 15 is a combination of some depictions from FIG. 2 and FIG. 13 which are illustrate as a quick reference wiring guide between the invention and one example of HVAC equipment.

FIG. 15 includes representations of the control board 8, A/C transformer 42 and A/C control board 41. This depiction is a visual wiring guide which illustrates how the inventions control board 8 could be wired to components of an air conditioner control board 41 and transformer 42.

Figure 16:
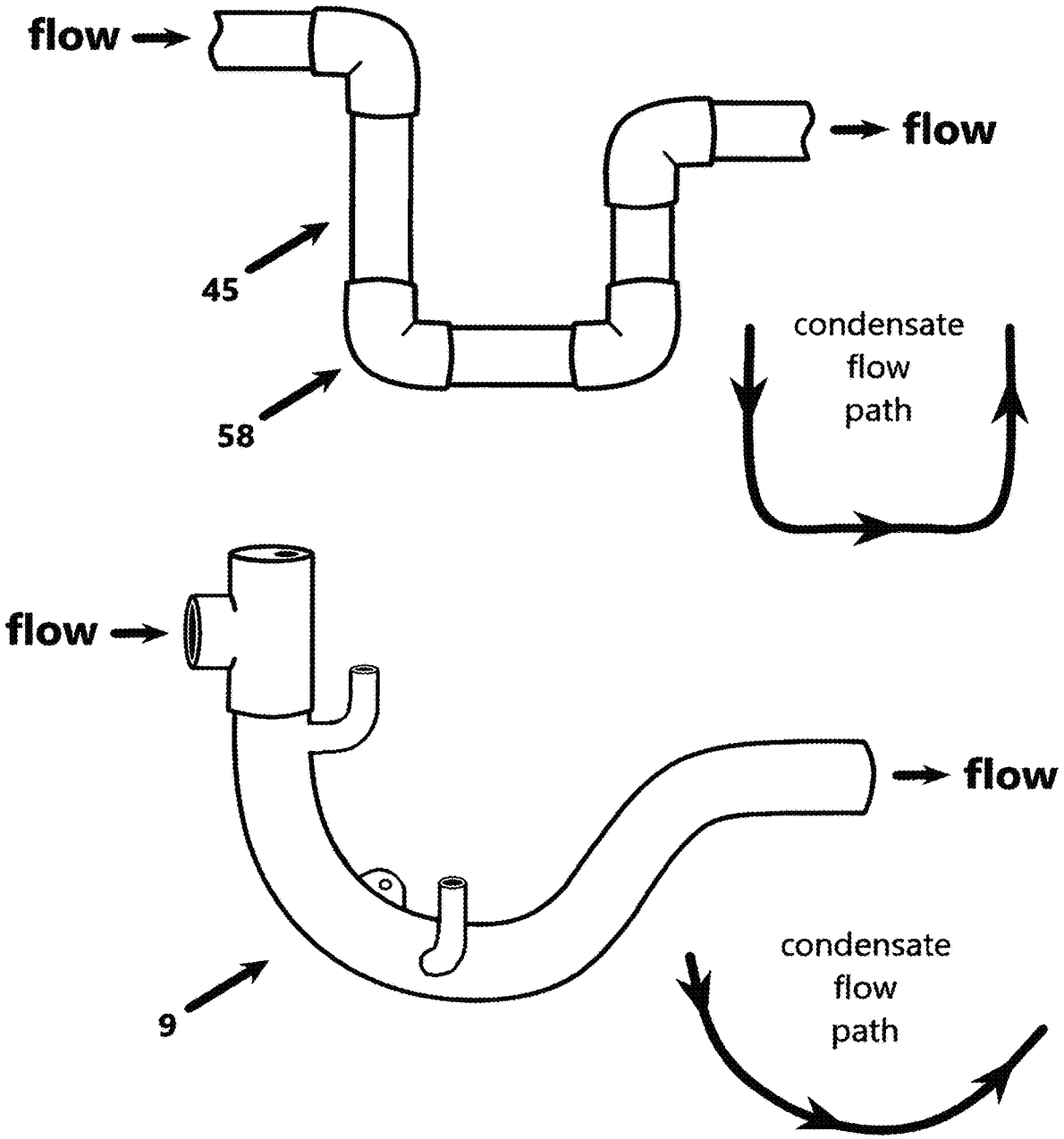
FIG. 16—FIG. 16 depicts a comparison of different condensate flow paths between the inventions pressure trap assembly 9, 1 and one example of a type of condensate fluid trap fabricated by connecting sections of condensate drain-pipe 45 and 90-degree pipe couplings 58.

FIG. 16 depicts a comparison between the different condensate flow paths of the inventions pressure trap assembly 9, 1 and one example of a type of condensate fluid trap fabricated by connecting sections of condensate drainpipe 45 and 90-degree pipe couplings 58.

Figure 17:
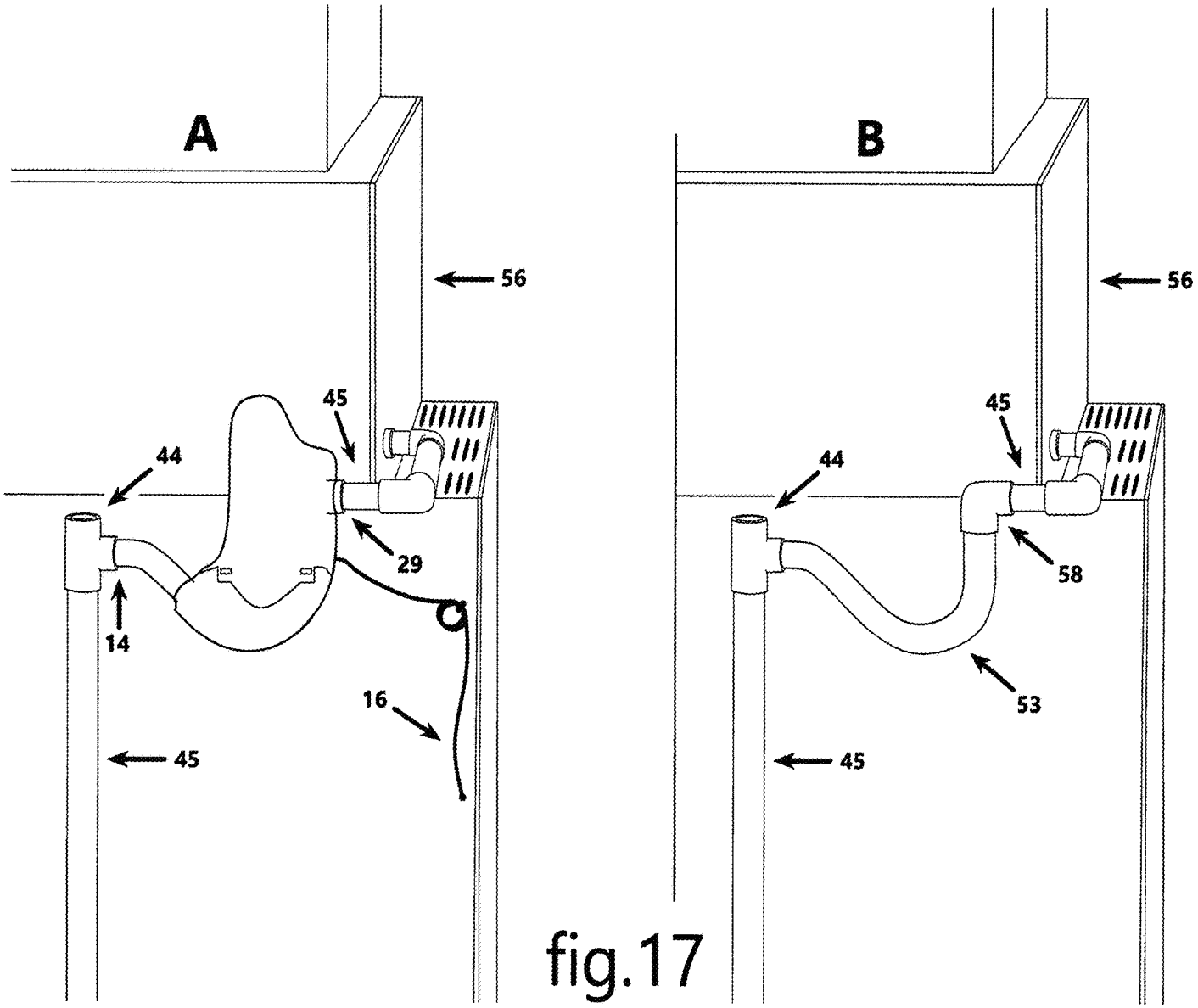
FIG. 17—FIG. 17 depicts two A, B split system evaporator coil cabinets 56. The images illustrate how the Self-cleaning condensate drain pressure trap for air conditioning is a drop-in replacement for the HVAC industry standard type pressure trap 53.

In FIG. 17 there are two (A & B) separate split system evaporator coil cabinets 56 depicted. The illustration shows how the installation of the invention is nearly identical to HVAC industry standard pressure trap 53. This comparison is relative to the inventions installation in all other instances where HVAC industry standard pressure trap 53 are installed.

Figure 18:
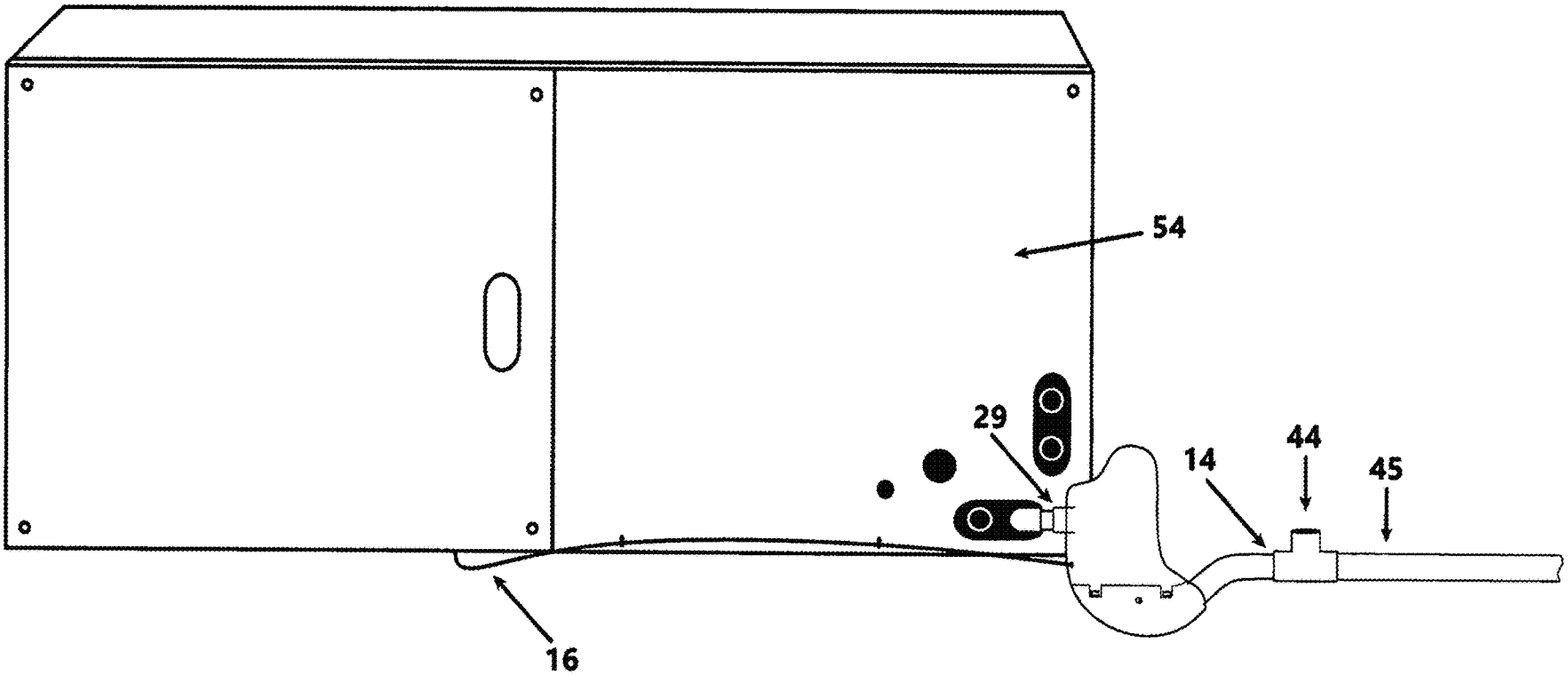
FIG. 18—FIG. 18 depicts the invention in a rear side profile view installed onto an example of a split system air handler 54.
Figure 19:
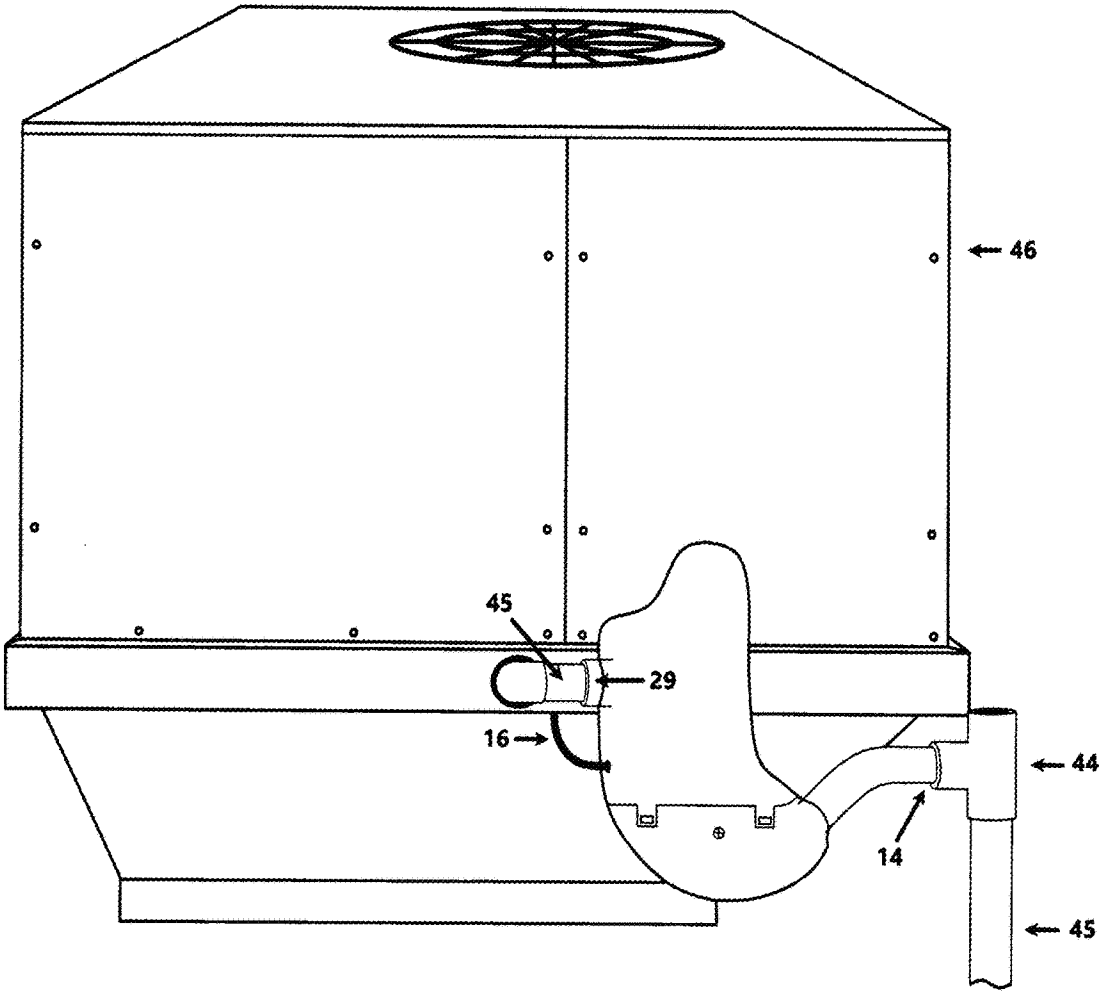
FIG. 19—FIG. 19 depicts the invention in a front side profile view installed onto one example of a package air conditioner 46.

FIGS. 17 through 19 illustrate the invention as installed in different configurations onto the condensate drainpipes 45 of three different types of air conditioning equipment 46, 54, 56.

Figure 20:
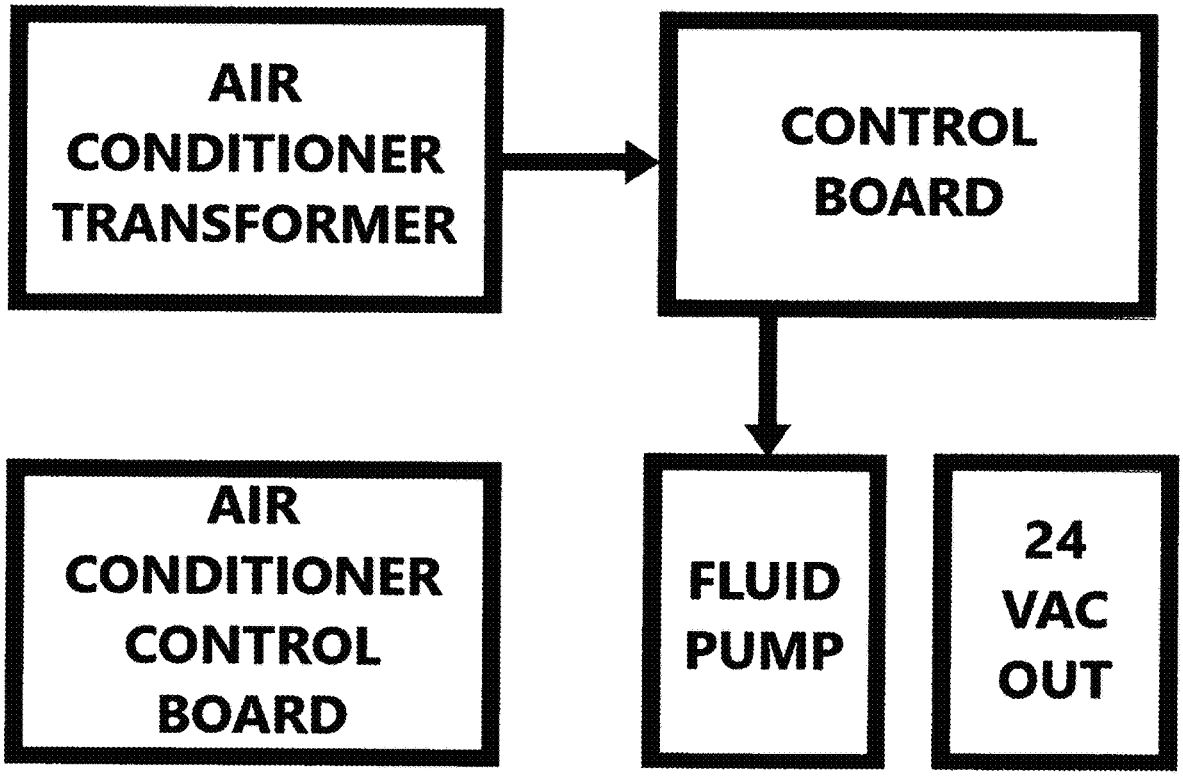
FIG. 20—FIG. 20 illustrates an electrical flow chart for the invention while in unclogging mode. Here the unclogging modes voltage flow path between electrical components is depicted.

FIG. 20—FIG. 20 illustrates an electrical flow chart for the invention while in unclogging mode. Here the unclogging modes voltage flow path between electrical components is depicted.

Figure 21:
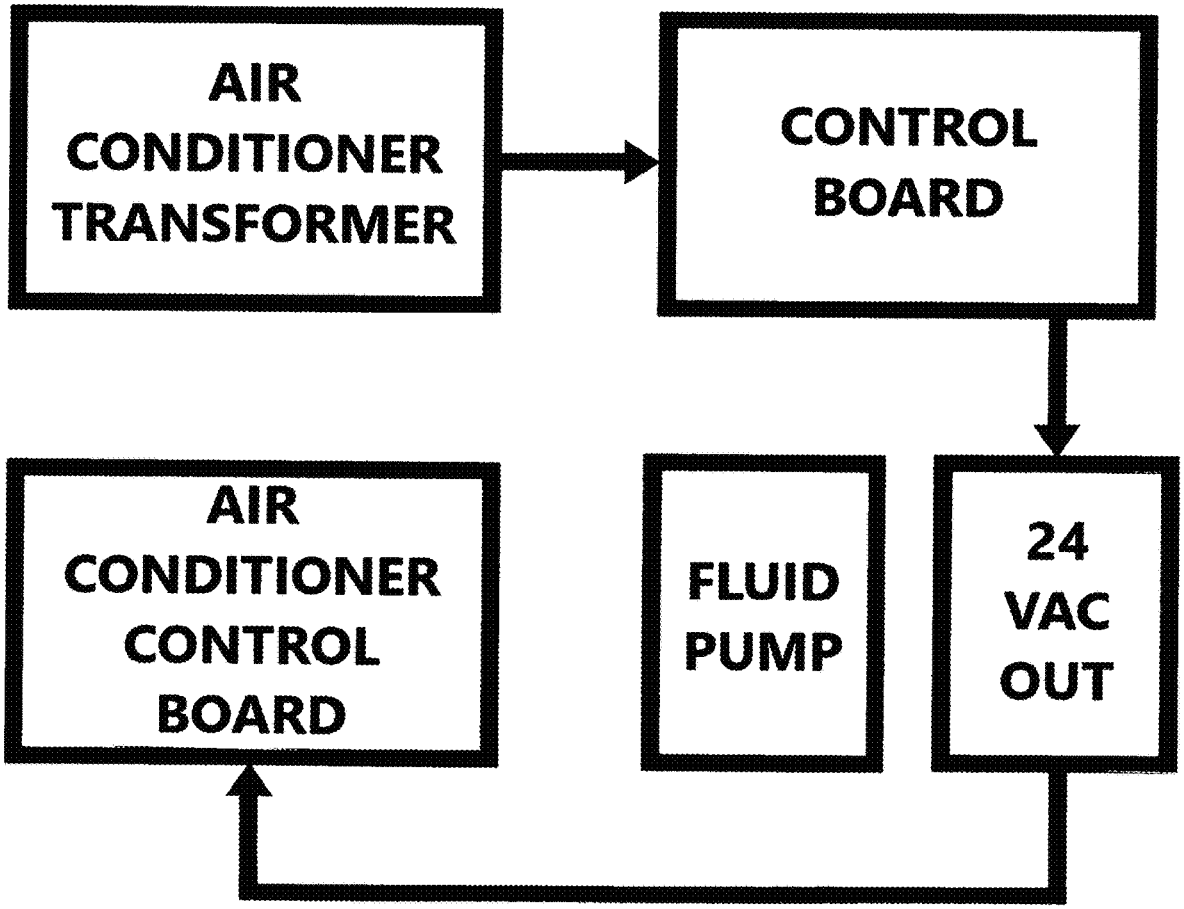
FIG. 21—FIG. 21 illustrates an electrical flow chart for the invention while in monitoring mode. Here the monitoring modes voltage flow path between electrical components is depicted.

FIG. 21—FIG. 21 illustrates an electrical flow chart for the invention while in monitoring mode. Here the monitoring modes voltage flow path between electrical components is depicted.

Figure 22:
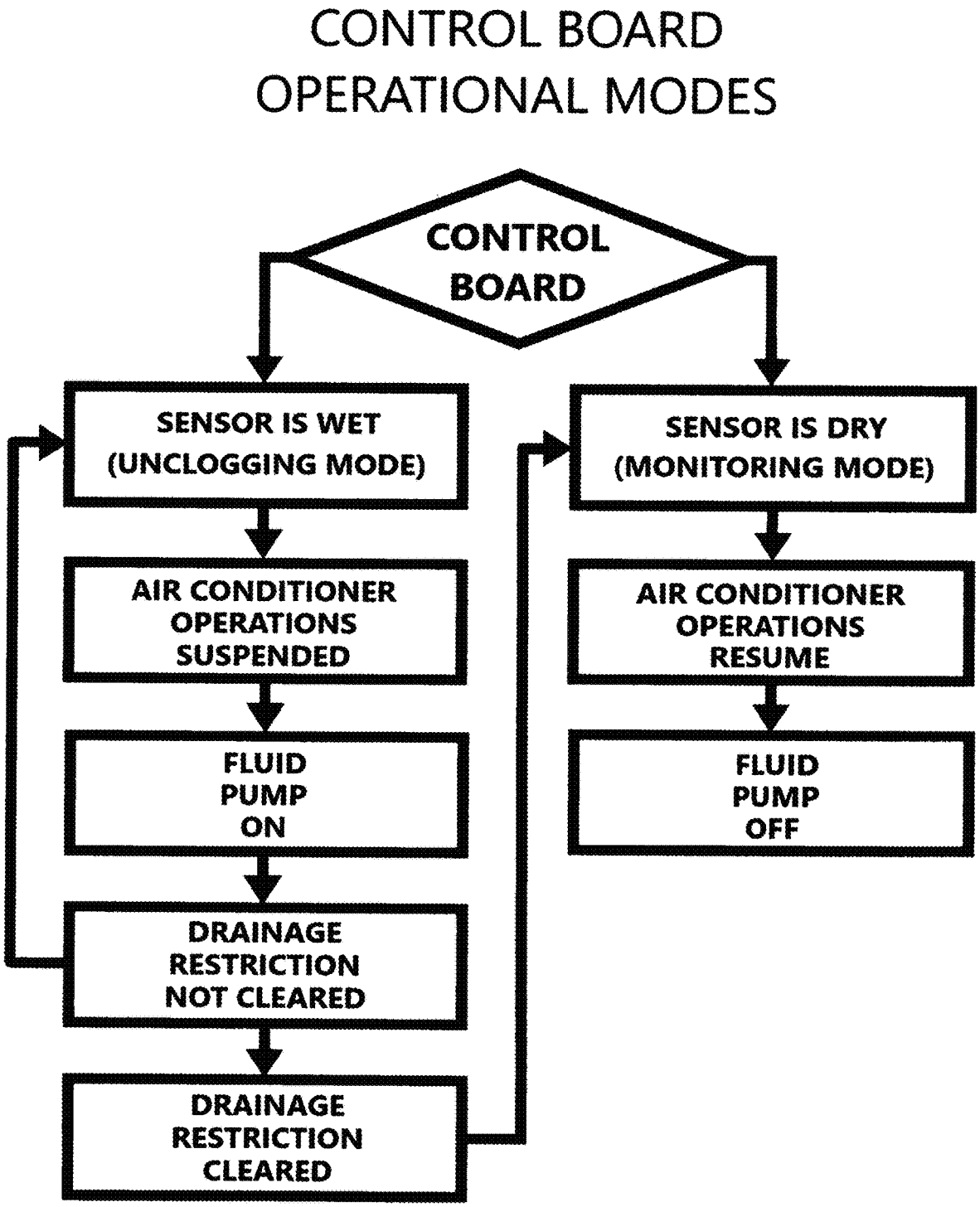
FIG. 22—FIG. 22 depicts a mechanical flow chart for the control board 8 sequence of operations in monitoring mode and unclogging mode.

FIG. 22—FIG. 22 depicts a mechanical flow chart for the control board 8 sequence of operations in monitoring mode and unclogging mode.

The FIGS. 1 through 22 have been briefly described and most of the specific points of interest enumerated. Not all the enumerated items illustrated in the figures are elements of the invention. Some items depicted in figures are necessary to illustrate how the invention is associated to relative art, or to explain the inventions operations. Only the items enumerated in FIGS. 1, 2, 3, 4 and 5 are possible components of the invention, although these items are also present in other figures. I will now describe in detail the relationship between the annotated figures and the sequence of operations for the invention Self-cleaning condensate drain pressure trap for air conditioning.

Condensate Pressure Trap Design

In preferred embodiments this invention is configured with at least one modified condensate drain pressure trap 9.

A fluid pressure trap is a section of drainpipe formed into a U-shape. In air conditioning the U-shaped fluid pressure trap is attached to an air conditioners condensate fluid drainpipe. The function of the condensate fluid pressure trap is to fully fill a section of a condensate drainpipe with fluid. This prevents the transmission of air through the drainpipe and allows for proper drainage flow.

I have found through over 15 years of professional residential and commercial HVAC/R service and repair that air conditioner condensate drain pressure traps 53 routinely incur evaporator coil debris 50 and bacterial slime, which forms into a pressure trap debris clog 47. A pressure trap debris clog 47 blocks condensate drainage through the pressure trap. This causes the condensate fluid 48 level to rise in the drain pan 52 and overflow the pan, flooding the air conditioner. Condensate fluid flooding causes vast amounts of damage throughout the United States every year. It stands to reason that HVAC industry standard pressure traps 53 needed to be redesigned in a manner which creates a solution to the pressure trap clogging and condensate fluid flooding issues caused thereby.

The inventions condensate fluid pressure trap 9 modifies the traditional HVAC industry standard pressure trap 53 design, allowing it to clear obstructions that can occur with the pressure traps 9 reservoir.

The inventions pressure trap 9 follows international mechanical codes 307.2.1 and 307.2.4 which define some requirements of a condensate pressure trap for air conditioning.

IMC 307.2.1 states " . . . such piping shall maintain a minimum horizontal slope in the direction of discharge of not less than . . . (1-percent slope)". This rule states that the condensate fluid drainpipe of an air conditioner must slope downhill with a rise of at least 1% of the drainpipe's length. The slope ensures that gravity as well as the flow of condensate will assist in the moving of condensate fluid towards drain points where it can be safely removed.

Attempting to create a 1% slope by elevating a drainpipe at one end is impractical and a practice only applied in certain cases where long condensate line runs are required. The drainpipe slope required by IMC 307.2.1 is generally achieved in condensate systems by installing a condensate pressure trap on the drainpipe which has a downward slope from its fluid inlet to its fluid outlet. The inventions pressure trap 9 pipe was designed to achieve this downward drainage slope.

In FIG. 6, the pressure trap assembly 9, 1 is shown to have a rise of 2.5 inches from the midpoint of the low side fluid port 14 to the midpoint of the high side fluid port 29. According to IMC 307.2.1 this 2.5-inch rise creates a slope suitable to accommodate a horizontal condensate drainpipe length of up to 20.8 feet. The slope of the inventions pressure trap 9 is consistent with that of HVAC industry standard pressure traps 53, as depicted in FIG. 14.

IMC 307.2.4 states "Condensate drains shall be trapped as required by the equipment or appliance manufacturer".

Most residential and commercial air conditioning manufacturers require their HVAC equipment have pressure traps installed onto their condensate drainpipes. The Self-cleaning condensate drain pressure trap for air conditioning is a condensate drain fluid pressure trap. It was designed to be attached to the condensate drainpipe 45 of an air conditioner without the assistance of any aftermarket parts or piping construction that might otherwise be necessary for the device to perform its function as a fluid pressure trap.

The inventions pressure trap 9 was designed with long sweeping radius bends that are conducive to the transmission of fluid and solids through the pipe. The sweeping bends create less of a debris trapping effect as fluid flows through the device. The bends are also conducive to proper drainage velocity. Where a pressure trap fabricated in the field with short radius 90 degree pipe couplings and such creates friction which slows down the fluids drainage velocity (see FIG. 16).

While the invention requires electrical power for its monitoring, unclogging and safety functions described herein it does not require electric power to perform its fluid pressure trap function. Fluid trapping by the inventions pressure trap 9 is an inherent function of the U-shaped pressure traps 9 design which should be evident to any persons skilled in the relative art.

Referring to FIG. 14 the inventions pressure trap 9 is depicted alongside an HVAC industry standard pressure trap 53. Here the likeness in design between the two pressure traps is evident. The inventions pressure trap 9 is shown with external molded pump access ports 10, 11 which are the basis of the devices unclogging ability. Pressure trap clogs generally gather at the bottom/reservoir of the pressure trap, where the low side pump access port 10 is located. The high side pump access port 11 is located at the upper portion of the pressure trap. The p-traps upper portion fills with condensate fluid only when a drainage restriction occurs.

Device Assembly

Referring to FIG. 1, the components of the the inventions pressure trap assembly and its mechanisms are depicted consisting of; the access coupling T 1; the pressure trap 9 with its pump access ports 10 and 11; the fluid pump 4; the upper and lower plastic tubes 7 and 12; fluid pump 4; control board 8 and mount 6; the sensor wires 3 and the splash guard 2. This figure represents the main pressure trap assembly and mechanisms but does not include all the inventions components.

in FIG. 2 the piping, tubing and electrical components from FIG. 1 are shown assembled. The access coupling T 1 is secured onto upper pipe end of the pressure trap 9, forming the pressure trap pipe assembly 9, 1. The fluid sensor assembly 2, 3 is inserted into the sensor hole 32 at the top of the access T 1. The plastic tubing upper 7 is secured onto the fluid pumps 4 input. The plastic tubing lower is secured onto the fluid pump 4 outlet. The fluid pump 4 is secured onto the pressure trap 9 by securing the bottom ends of the plastic tubing upper 7 onto the high side pump access port and securing the plastic tubing lower 12 onto the low side pump access port. The PCB mounting bracket 6 is secured by screw onto the control mounting tab 15. The control board 8 is mounted by screws onto the PCB mounting bracket 6. Resins or glues are applied to most or all the plastic pipe and tube connections to ensure watertight integrity.

In FIG. 2 The inventions electrical components are shown connected. The fluid pump wires 5 are inserted into the control board terminal labeled "pump" 31. The sensor wires 3 are inserted into the control board terminal labeled "sensor" 30. The connector cable 16 is secured in the control board 8 where; wire A 22 is secured to terminal "24 vac in"; wire B 24 is secured to terminal "24 vac out"; wire C 23 is secured to terminal "common".

In FIG. 4 the inventions fully assembled and encapsulated front side profile is depicted. The outer covers 18, 20 are snapped/secured together at the mating clips 25, 26. The high side fluid port 29 protrudes from the top cover 20. The low side fluid port 14 protrudes from the bottom cover 18. The connector cable protrudes from the top cover 20 through the cable hole 34.

In FIG. 5 the inventions fully assembled and encapsulated rear side profile is depicted. This view is the reverse of FIG. 4. Here the top 20 and bottom 18 covers are secured by the mating clips 17, 21 and secured by a screw 19.

Operational Wiring, Modes and Functions

A series of listed figures will now illustrate: the operational wiring of the invention to HVAC equipment including air conditioners; a clogging of the pressure traps 9 primary condensate drainage flow path; the monitoring and unclogging modes sequence of operations. The following examples of air conditioners 46, 54, 56 and their connected drain piping 44, 45, 58 illustrated in these figures are not parts of the invention and are depicted for instructional purposes only. Many of the figures representing the invention depict the device without the outer covers 18, 20 included in the images. This is to facilitate the explanations of the invention and its interactions with various elements with greater visual clarity. There are also some fictional cut away views of various elements that help to visualize the inventions interactions and functions.

In FIG. 15 the connector cable wire A 22 is depicted connecting an air conditioner transformers 42 24-volt ac supply wire 35 to the inventions control board 8 terminal marked "24 vac in". The inventions control board 8 is electrically powered through this connection.

In FIG. 15 the connector cable wire B 24 is depicted connecting the inventions control board 8 terminal marked "24 vac out" to an air conditioners control board 41 terminal marked "24 vac". Through this connection the control board 8 either conducts or disconnects electric current for the controlling of an air conditioners operations and condensate production.

The connector cable wire C 23 is depicted connecting the inventions control board 8 terminal marked "common" to an air conditioners transformer common wire 36 and an air conditioner control boards common wire 38. These common wire connections complete the 24-volt ac circuits being made with the invention and an air conditioner.

The connector cable 16 serves two functions. Connector cable 16 function one—To conduct electric current from an air conditioner transformer 42 to the inventions control board 8 to electrically power the invention. Connector cable 16 function two—To conduct electric current from the inventions control board 8 to an air conditioner control board 41, to either energize or de-energize the air conditioners control board 41.

In FIG. 7 the inventions pressure trap assemblies partially exploded backside is depicted where the device is installed onto an operational condensate fluid drainpipe system. The inventions high side fluid port 29 is installed onto the condensate drainpipe 45 of an air conditioner. A drainpipe 45 extension is secured onto the inventions low side fluid port 14 by a pipe coupling 44. A cutaway view into the pressure trap 9 illustrates a normal operating level of condensate fluid within the device's reservoir. The normal operating level of condensate fluid 48 in the pressure traps reservoir prevents the transmission of air through the drainpipe, allowing for proper condensate fluid drainage 48 through the condensate drainpipe system. Note the orifices of the pump access ports 10, 11 inside the pressure trap 9, as well as the amount of evaporator coil debris 50 accumulated in the pressure traps 9 reservoir.

In FIG. 8 the pressure trap assembly from FIG. 7 has formed a pressure trap debris clog 47 due to the further accumulation of evaporator coil debris 50 in the reservoir. The pressure trap debris clog 47 is blocking the condensate fluids 48 primary drainage path through the pressure trap 9. Consequently, condensate fluid 48 is rising into the access coupling T 1 and the splash guard 2 submerging the high side access port 11 and sensor wires 3 in condensate fluid 48. The submerged sensor wires 3 now report a state of being wet to the control board 8 sensor terminal 30. This depiction is aided by an access coupling T 1 cutaway view.

The wet fluid sensor wires 3 in FIG. 8 have actuated the control board 8 to the unclogging mode where the control board 8 disconnects electric current from its "24 vac out" terminal. This action de-energizes the air conditioner control board 41 halting air conditioner operations and further condensate fluid 48 production. The control board 8 then energizes the pump terminal 31, actuating to pump to on by supplying 24 vdc to the fluid pump wires 5.

In FIG. 9 the energized fluid pump 4 of FIG. 8 pumps condensate fluid along the fluid pumping flow path where; condensate fluid 48 is pumped out of the pressure traps 9 high side pump access port 11; condensate fluid 48 is pumped upward through the plastic tubing upper 7; fluid enters the fluid pumps 4 input; fluid exits the fluid pumps 4 output; fluid is pumped downward through the plastic tubing lower 12; fluid is pumped into the low side pump access port 10 whereby condensate fluid is pumped directly into the pressure traps 9 reservoir and into the pressure trap debris clog 47.

In FIG. 9, the condensate fluid is pumped into the pressure trap 9 at an angle perpendicular to the primary condensate flow. The fluid is dispersed about the reservoir as it is pumped against the clog 47 and the inside wall of the pipe. This creates a swirling fluid motion in the reservoir which stirs up the debris clog 47. The pressure trap debris clog 47 is loosened and broken down into smaller debris particles 61 by the swirling fluid. It is important to note that the fluid pumped into the pressure trap 9 is not directed either upstream towards the high side fluid port 29 or downstream towards the low side fluid port 14. The pumped condensate fluid mostly just circulates between the two pump access ports 10, 11.

Referring now to FIG. 11, the high level of condensate fluid 49 in the condensate drain pan 52 begins flowing through the loosened debris clog 47 from FIG. 9. As the smaller debris particles 61 are carried away with the draining condensate fluid 48 the velocity of the draining fluid begins increasing. The now heavy and increasingly fast flowing current of condensate fluid 48 flushes the rest of the debris particles 61 out of the pressure trap 9. This natural flushing process is aided only by the slope of the pressure trap and the gravitational pull on the condensate fluid 48. This depiction is aided by the cutaway views of the pipe coupling 44, evaporator coil cabinet 56, drain pan 52 and condensate drainpipe 45.

Moving to FIG. 10, the encapsulated rear side view of the invention is depicted with cutaway view of the bottom cover 18, pressure trap 9, evaporator cabinet 56 and drain pan 52. Here the condensate fluid 48 has drained out of the condensate drain pan 52 and the pressure trap debris clog 47 has been flushed out of the pressure trap 9. The drain pan 52 and the pressure trap 9 are now at normal operating levels of condensate fluid 48. The lowered fluid level 55 puts the sensor wires 3 into a dry state.

The dry sensor wires 3 actuate the final sequence of the unclogging mode. The control board 8 goes into a 15 second delay to prove that the sensor wires 3 stay dry. During the 15 second delay the control board 8 continues to energize the fluid pump 4 and de-energize the air conditioner control board 41. If the sensor wires 3 remain in the dry state for 15 seconds the control board 8 delay ends, and the control board 8 returns to the monitoring mode.

When in the control boards 8 monitoring mode the fluid pump 4 is de-energized and the air conditioner control board 41 is re-energized, to resume air conditioner operations. The monitoring mode is the inventions static state where no work is done, and the invention expends no energy. This allows the invention to be energy efficient and have an increased lifespan. The device will actuate into unclogging mode if the sensor wires 3 become wet.

Installation Configurations

The Self-cleaning condensate pressure trap for air conditioning was designed to be installed onto condensate drainage systems in a manner like the HVAC industry standard pressure trap 53. The devices access coupling T 1 connects directly onto an air conditioners condensate drainpipe 45. The devices low side fluid port 14 can accommodate any type of like sized pipe coupling for the routing of any further condensate drainpipe extensions.

Referring to FIG. 17, There are two A, B split system evaporator coil cabinets 56 depicted side by side. The Invention is illustrated installed onto the condensate drainpipe 45 of evaporator coil cabinet A. The HVAC industry standard pressure trap 53 is depicted installed onto evaporator coil cabinet B. These depictions illustrate that the Self-cleaning condensate pressure trap for air conditioning can be utilized as a drop-in replacement for HVAC industry standard pressure traps 53 due to the like size and configuration of piping connections. This should be evident to any person skilled in the relative art. The only difference in installations is that the electrical connections of the connector cable 16 need to be made to the HVAC equipment.

In FIG. 18 The invention is depicted installed onto one example of a split system air handler 54. The device is installed onto the condensate drainpipe 45 of the HVAC equipment in the same configuration as a HVAC industry standard pressure trap 53 would be. The devices connector cable 16 is routed into the HVAC equipment's electric service panel to facilitate the inventions electrical connections. This depiction illustrates that the Self-cleaning condensate pressure trap for air conditioning can be utilized as a drop-in replacement for HVAC industry standard pressure traps 53, which should be evident to any person skilled in the relative art.

In FIG. 19 The invention is depicted in one example of its installation onto a package air conditioner 46. The device is installed onto the condensate drainpipe 45 of the HVAC equipment in the same configuration as an HVAC industry standard pressure trap 53 would be. The devices connector cable 16 is routed into the HVAC equipment to facilitate the inventions electrical connections. This depiction illustrates that the Self-cleaning condensate pressure trap for air conditioning can be utilized as a drop-in replacement for HVAC industry standard pressure traps 53, which should be evident to any person skilled in the relative art.

While preferred materials for elements have been described, the invention is not limited by these materials. Any materials such as rubber, foam, aluminum, wood or any material which the device could be fashioned from may comprise some or all the elements of the Self-cleaning condensate drain pressure trap for air conditioning in various embodiments of the present invention.

Although the present invention has been illustrated and described herein with reference to preferred embodiments and specific examples, it will be readily apparent to any person skilled in the relative art that other embodiments and examples may perform similar functions and achieve like results. All such equivalent embodiments and examples are within the spirit and scope of the present invention, are contemplated thereby, and are intended to be covered by the following claims.

What I claim:

1. A Self-cleaning condensate drain pressure trap for an air conditioner, the Self-cleaning condensate drain pressure trap comprising:

a pressure trap;

a T shaped pipe coupling coupled to an upper pipe end of the pressure trap;

wherein the T shaped pipe coupling is a condensate inlet and a pressure trap lower pipe end is a condensate outlet;

a primary condensate flow path from the T shaped pipe coupling through to the the pressure trap lower pipe end;

a separate fluid pumping flow path from a pump access port on the upper portion of the pressure trap to a second pump access port on a bottom of the pressure trap;

wherein the bottom of the pressure trap includes a reservoir;

wherein the separate fluid pumping flow path into the reservoir is at an angle perpendicular to the primary condensate flow path in order to create a whirlpool effect in the reservoir;

wherein the perpendicular fluid pumping angle is designed to only disturb the reservoir of the pressure trap;

a low-pressure fluid pump which is coupled to the fluid pumping flow path;

wherein the fluid pump exerts a negative pressure at the upper portion of the pressure trap and a positive pressure at the reservoir of the pressure trap during an unclogging mode;

a control board with a fluid sensor;

wherein the control board actuates a monitoring mode when the fluid sensor is dry;

wherein the control board actuates an unclogging mode when the fluid sensor is wet;

a connector cable which conducts an electric current between the control board and the air conditioner;

an outer protective cover with openings for the condensate inlet, condensate outlet and the connector cable;

wherein the cover encases the fluid pump, control board and most of the pressure trap assembly in order to protect those mechanisms from weathering damages.

2. The Self-cleaning condensate drain pressure trap for an air conditioner of claim 1 wherein the modified pressure trap prevents the transmission of air through a condensate drainpipe, allowing for proper drainage.

3. The Self-cleaning condensate drain pressure trap for an air conditioner of claim 1 wherein a debris clog within the pressure trap, or elsewhere in a condensate drainage system causes a condensate fluid level to rise to a high-level mark within the pressure trap.

4. The Self-cleaning condensate drain pressure trap for an air conditioner of claim 3 wherein the fluid sensor includes a plurality wires and the wires become wet where fluid reaches a high-level mark.

5. The Self-cleaning condensate drain pressure trap for an air conditioner of claim 4; wherein the wet wires actuate the control board to the unclogging mode; and an operation of the air conditioner is suspended by the control board.

6. The Self-cleaning condensate drain pressure trap for an air conditioner of claim 4 wherein the wet wires actuate the control board to the unclogging mode; and the fluid pump is energized.

7. The Self-cleaning condensate drain pressure trap for an air conditioner of claim 6 wherein the debris clog in the pressure trap is broken down by the fluid pump.

8. The Self-cleaning condensate drain pressure trap for an air conditioner of claim 7 wherein a low pumping pressure of the fluid pump cannot flush out the pressure trap or any connecting condensate drainpipe.

9. The Self-cleaning condensate drain pressure trap for an air conditioner of claim 7 wherein a condensate fluid in an air conditioner drain pan can begin to drain through the broken-down debris clog.

10. The Self-cleaning condensate drain pressure trap for an air conditioner of claim 9 wherein the condensate fluid draining out from the air conditioner drain pan flushes out the debris clog causing the condensate fluid level to recede to a normal operational level.

11. The Self-cleaning condensate drain pressure trap for an air conditioner of claim 10 wherein the fluid sensors become dry where fluid recedes to the normal operational condensate level.

12. The Self-cleaning condensate drain pressure trap for an air conditioner of claim 11 wherein the dry fluid sensor actuates the control board to a 15 second delay to prove the normal operational condensate level.

13. The Self-cleaning condensate drain pressure trap for an air conditioner of claim 12 wherein when the 15 second delay proves the normal operational condensate level the control board actuates to the monitoring mode, whereby the operation of the air conditioner is resumed and whereby the fluid pump is de-energized.

14. The Self-cleaning condensate drain pressure trap for an air conditioner of claim 5 wherein if the sensor remains wet the control board will remain in unclogging mode.

15. The Self-cleaning condensate drain pressure trap for an air conditioner of claim 14 wherein an unsuccessful unclogging mode may indicate a drainage restriction elsewhere in the condensate drainage system; and the operation of the air conditioner remain suspended for the prevention of further condensate fluid production and the flooding caused thereby.

* * * * *